US005957222A

United States Patent [19]

Webb et al.

[11] Patent Number: 5,957,222

[45] Date of Patent: Sep. 28, 1999

[54] DIRECTIONAL DRILLING SYSTEM

[75] Inventors: Charles T. Webb, 8050 John Henry, Burleson, Tex. 76028; Roy L. Chandler, Arlington, Tex.

[73] Assignee: Charles T. Webb, Burleson, Tex.

[21] Appl. No.: 09/093,747

[22] Filed: Jun. 8, 1998

Related U.S. Application Data

[60] Provisional application No. 60/049,283, Jun. 10, 1997.

[51] Int. Cl.[6] ..... E21B 7/06

[52] U.S. Cl. ..... 175/45; 175/74

[58] Field of Search ..... 175/61, 62, 73, 175/76, 75, 38, 45, 74, 19; 340/853.4

[56] References Cited

U.S. PATENT DOCUMENTS

| | | | |
|---|---|---|---|
| 3,042,125 | 7/1962 | Duncan . | |
| 3,043,381 | 7/1962 | NcNeely, Jr. . | |
| 3,363,704 | 1/1968 | Farris et al. . | |
| 3,617,865 | 11/1971 | Hakata . | |
| 3,630,295 | 12/1971 | Coyne . | |
| 4,076,084 | 2/1978 | Tighe | 175/73 |
| 4,281,723 | 8/1981 | Edmond et al. . | |
| 4,416,339 | 11/1983 | Baker et al. . | |
| 4,732,223 | 3/1988 | Schoeffler et al. . | |
| 4,895,214 | 1/1990 | Schoeffler | 175/38 |
| 4,953,638 | 9/1990 | Dunn . | |
| 5,423,388 | 6/1995 | Hale . | |
| 5,458,208 | 10/1995 | Clarke . | |
| 5,469,155 | 11/1995 | Archambeault et al. . | |
| 5,490,569 | 2/1996 | Brotherton et al. . | |

*Primary Examiner*—William Neuder
*Attorney, Agent, or Firm*—Arthur F Zobal

[57] ABSTRACT

The apparatus, in one embodiment has a front shaft support and a guide housing coupled together for longitudinal movement relative to each other. A shaft extends through the front shaft support and the guide housing and has a drill bit coupled to its forward end. The shaft and front shaft support may be moved to a forward drilling position or to a rearward shifting position relative to the guide housing. A plurality of cams are coupled to the inside of the guide housing at different angular positions around the shaft. A cam follower is coupled to a cam follower housing which surrounds the shaft. In the shifting mode, the cam follower is disengaged from the cams. A clutch is provided for coupling the cam follower housing to the shaft when the shaft is in the shifting position such that the cam follower housing and the cam follower may be rotated with the shaft relative to the cams to allowed the cam follower to engage a selected one of the cams when the shaft is moved to the forward drilling position. In the forward drilling position of the shaft, the clutch releases the cam follower housing from the shaft and the cam follower engages the selected cam to allow straight drilling to occur or to cause the axis of said guide housing to shift relative to the axis of the shaft to cause the direction of drilling by the shaft and drill bit to change.

33 Claims, 16 Drawing Sheets

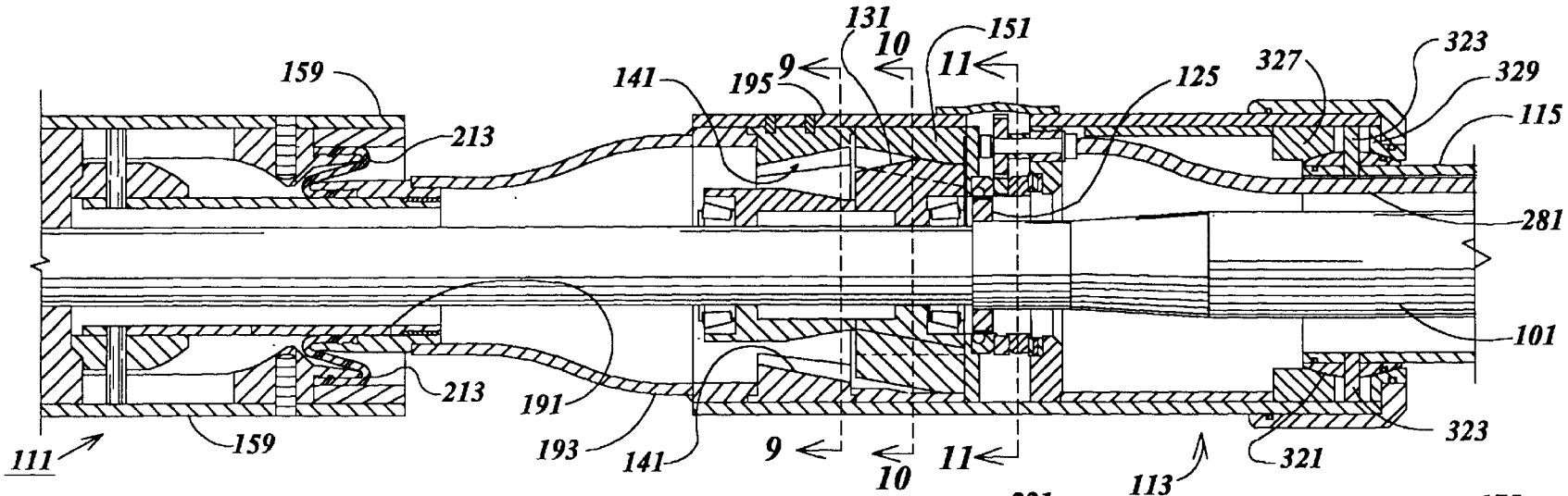
FIG. 4
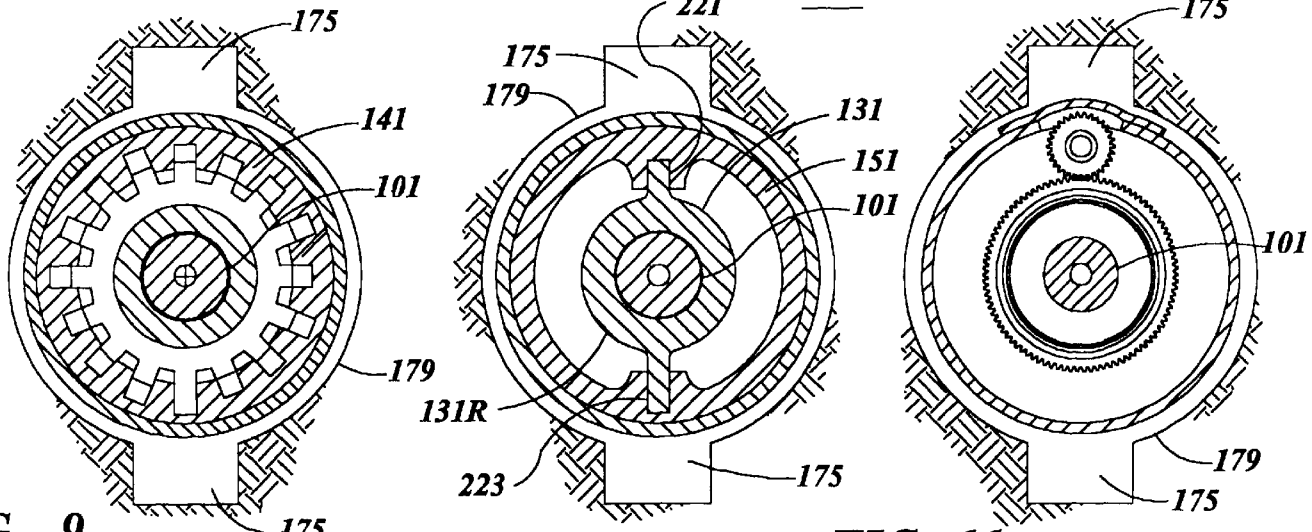
FIG. 11
FIG. 10
FIG. 9

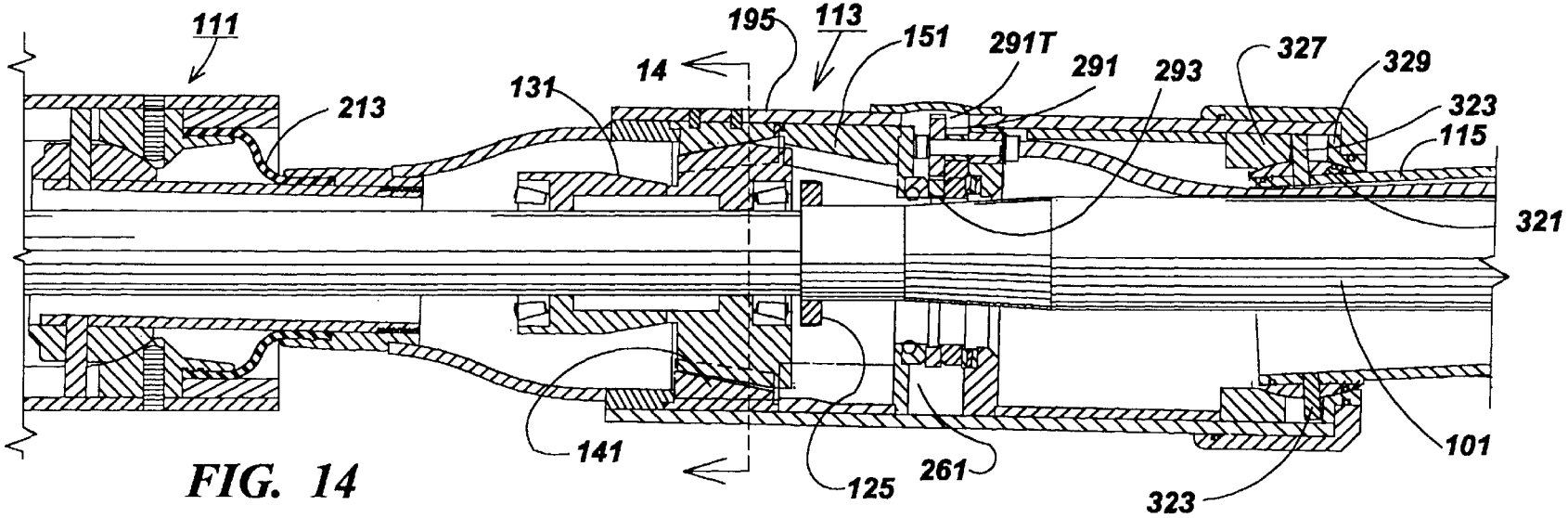
FIG. 14
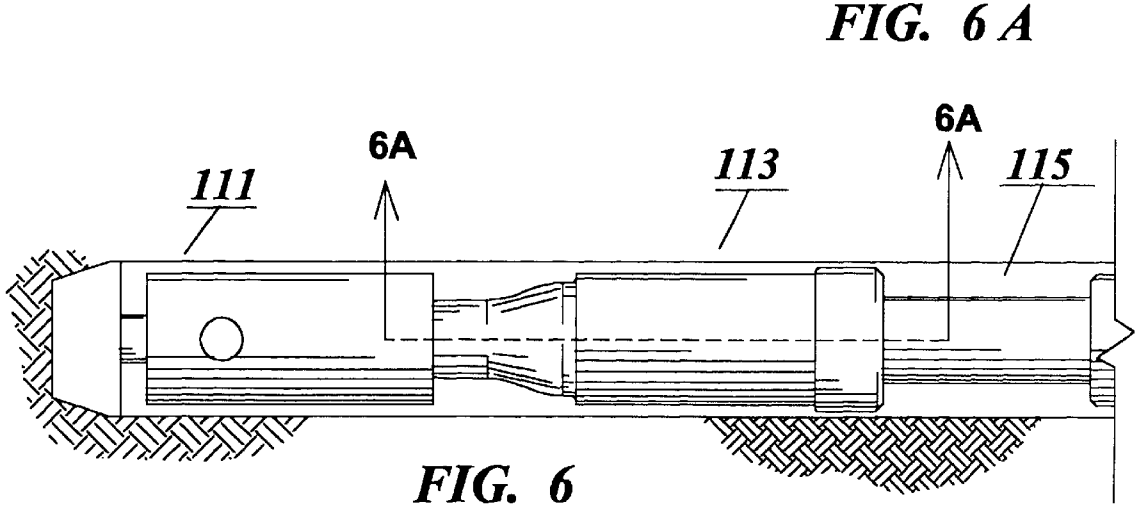
FIG. 6
FIG. 6 A
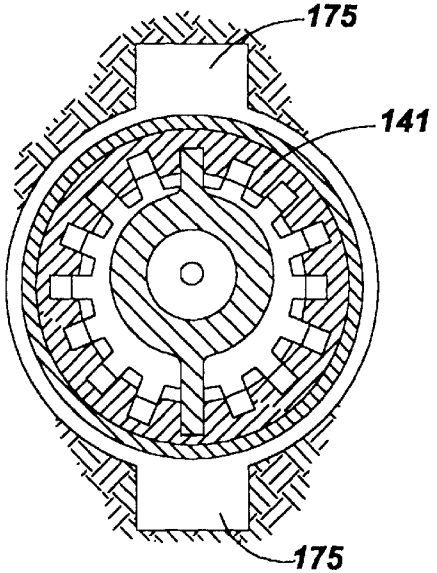

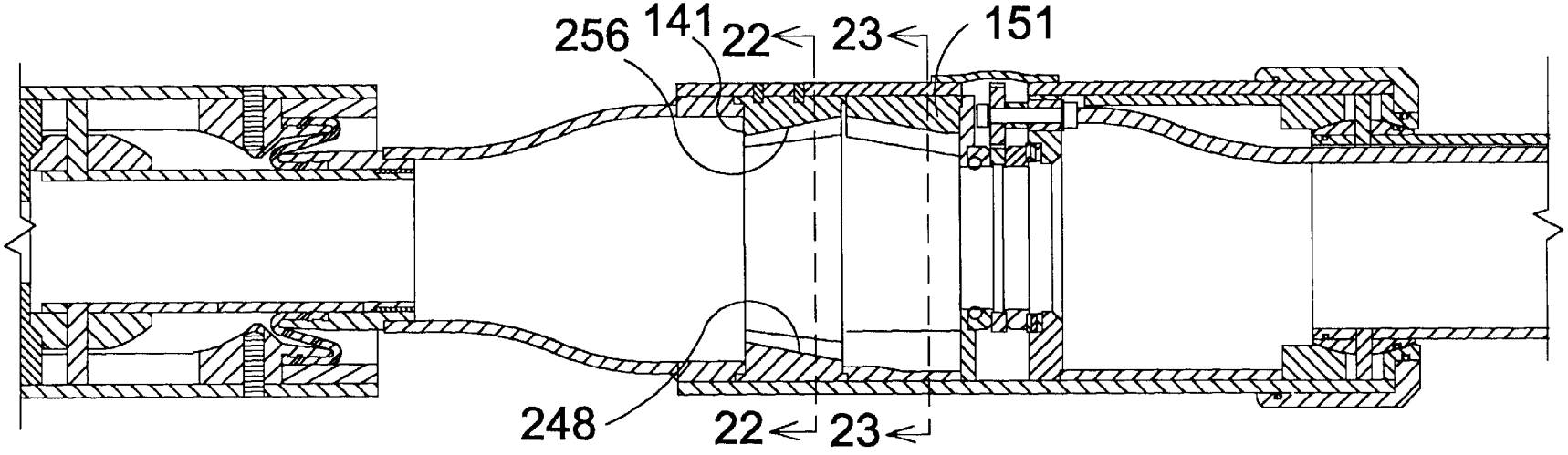
FIG. 21
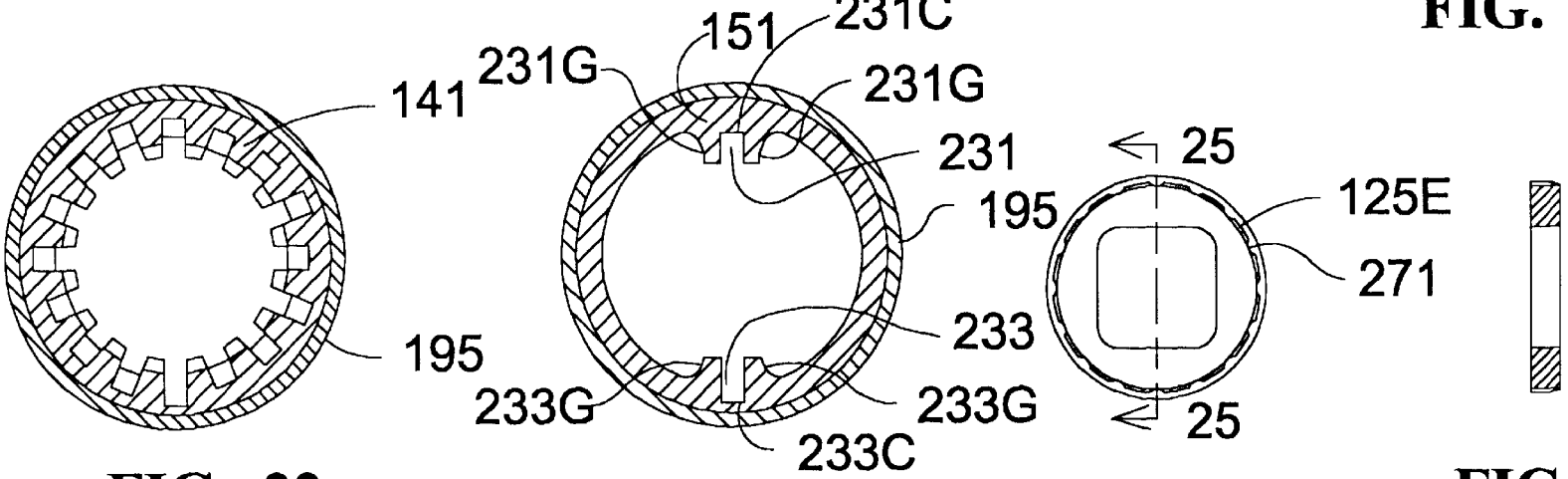
FIG. 24
FIG. 23
FIG. 22
FIG. 25

DIRECTIONAL DRILLING SYSTEM

This application is a continuation-in-part of U.S. Provisional Application Ser. No. 60/049,283, filed Jun. 10, 1997.

BACKGROUND OF THE INVENTION

1. Field of the Invention

The invention relates to a drilling system for drilling a borehole in the earth with a directional control system.

2. Description of the Prior Art

In recent history, the utility industry has been using methods of placing conduits and cable in the ground without forming trenches. This is known as trenchless technology and is carried out by drilling, using machines that advance a drill string into the ground and guiding it around obstacles to the exit point desired. There is no problem in drilling in dirt using techniques and equipment similar to those found in U.S. Pat. No. 4,953,638. Also the oil and gas drilling systems have for many years used devices to direct a drill stem to desired locations. These systems use devices such as whipstocks and downhole motors mounted on bent shafts. When the drilling system, used by the utility industry, encounters rock, the operators have used downhole motors and devices that use two stems, one for cutting and one for steering such as disclosed in U.S. Pat. No. 5,490,569. It requires a special machine to operate these systems and the cost of such machines is very high. Moreover the downhole motors that use water, require environmental clean up which present problems. Other prior art drilling systems are disclosed in U.S. Pat. Nos. 4,281,723, and 5,423,388.

SUMMARY OF THE INVENTION

It is an object of the invention to provide a new and useful directional drilling apparatus.

The apparatus comprises a guide housing having a shaft extending therethrough. A cutting means is coupled to the forward end of the shaft for drilling purposes upon rotation of the shaft. The shaft is movable longitudinally relative to the guide housing such that the shaft may be moveable to a forward drilling position relative to the guide housing and to a rearward shifting position relative to the guide housing. Cam means is coupled to the guide housing at different angular positions around the shaft. A cam follower is coupled to a cam follower housing which surrounds the shaft. The cam follower is disengaged from the cam means and the cam follower housing and cam follower are rotatable together relative to the guide housing when the shaft is in the shifting position. The cam follower is movable longitudinally with the shaft relative to the cam means. A clutch is provided for coupling the cam follower housing to the shaft when the shaft is in the shifting position such that the cam follower housing and hence the cam follower may be rotated by the shaft relative to the cam means to allow the cam follower to engage the cam means at a selected angular position around the shaft when the shaft is moved to the forward drilling position. When the shaft is moved toward the forward drilling position, the clutch allows the cam follower housing to be uncoupled from the shaft such that in the forward drilling position of the shaft, the cam follower engages the cam means and causes the guide housing to shift relative to the shaft to cause the direction of drilling to change.

In a further aspect, a rotational indicator is coupled to the cam follower for rotation therewith and relative to the guide housing for indicating the rotational position of the cam follower relative to the cam means. This information is transmitted to the surface by a radio frequency signal.

In one embodiment, the cam means comprises a conical shaped surface and at least one other surface to be selectively engaged by the cam follower.

In another embodiment the cam means comprises a plurality of cams coupled to the guide housing at different angular positions around the shaft.

In the embodiment disclosed, the cam follower comprises two cam members spaced 180 degrees apart with one of the members adapted to be used for engaging the cam means. The cam follower housing comprises two slots spaced 180 degrees apart for slidably receiving the two cam members respectively such that the two cam members are located in the two slots when the shaft is in the drilling position and in the shifting position.

In one embodiment the apparatus comprises a singe housing.

In another embodiment, a front shaft support housing is coupled to the guide housing for longitudinal movement relative to the guide housing. The shaft extends through the front shaft housing and is coupled thereto for movement with the shaft relative to the guide housing when it is moved to its drilling position and shifting position.

In a further aspect, a rear shaft support housing is coupled to the guide housing. The front shaft support housing, said guide housing and said rear shaft support housing are in fluid communication with each other and define an interior volume that varies when the front shaft support housing is moved by the shaft relative to the guide housing. A lubricating liquid is located in the front shaft support housing, the guide housing, and the rear shaft support housing. A pressure equalizer means is located in one of the housings and has a passageway in communication with the exterior for receiving and discharging borehole water when the interior volume of the apparatus increases and decreases.

BRIEF DESCRIPTION OF THE DRAWINGS

FIG. 4 is a cross-sectional view of FIG. 1 taken along the lines 4—4 thereof.

FIG. 6 is a partial view of the apparatus of FIG. 1.

FIG. 6A is a cross-sectional view of FIG. 6 taken along the lines 6A—6A thereof.

FIG. 9 is a cross-sectional view of FIG. 4 taken along the lines 9—9 thereof.

FIG. 10 is a cross-sectional view of FIG. 4 taken along the lines 10—10 thereof.

FIG. 11 is a cross-sectional view of FIG. 4 taken along the lines 11—11 thereof.

FIG. 14 is a cross-sectional view of FIG. 6 taken along the lines 14—14 thereof.

FIG. 21 is a cross-sectional view of the apparatus similar to that of FIG. 4 but with the shaft removed.

FIG. 22 is a cross-sectional view of FIG. 21 taken along lines 22—22 thereof.

FIG. 23 is a cross-sectional view of FIG. 21 taken along lines 23—23 thereof.

FIG. 24 is a side view of the sprocket which is connected to the shaft.

FIG. 25 is a cross-sectional view of FIG. 24 as seen along lines 25—25 thereof.

DESCRIPTION OF THE PREFERRED EMBODIMENTS

Figure 1:
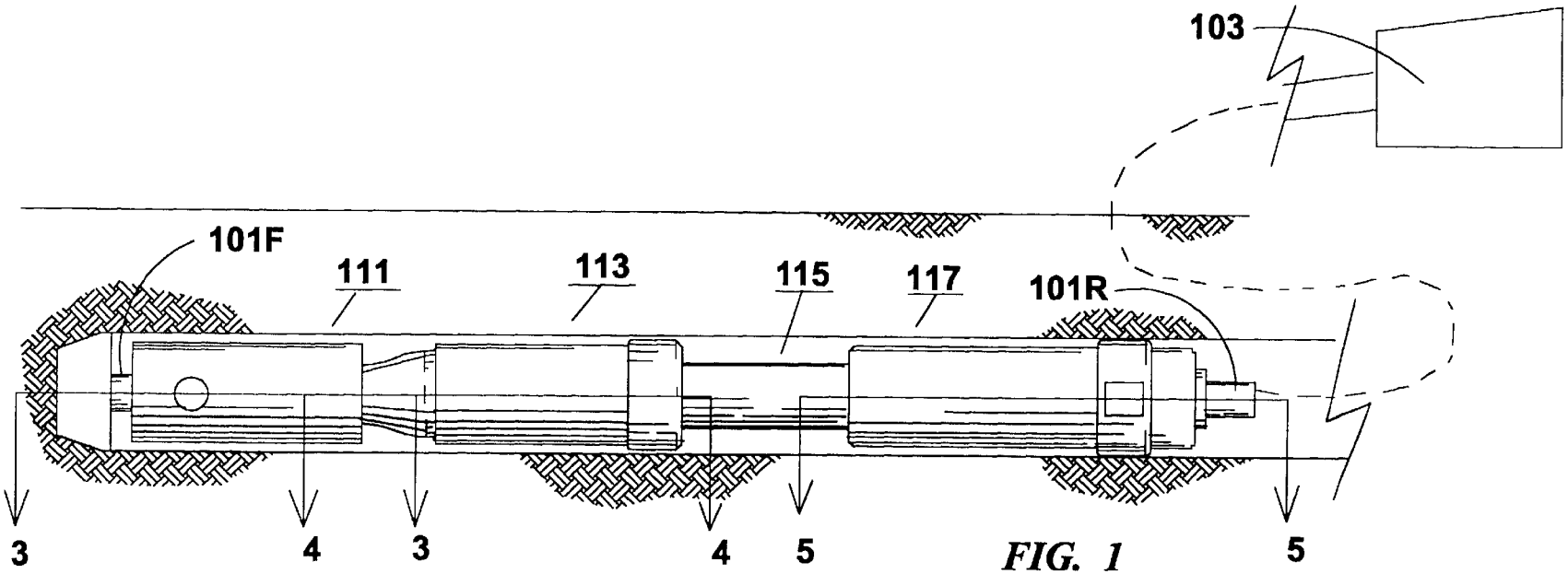
FIG. 1 illustrates the drilling apparatus of the invention in a shifting motion.

Referring to the drawings, the apparatus comprises a shaft 101 having a rear end 101R connectable to a drilling system 103 and a drill bit 105 connectable to the front end 101F. The shaft 101 extends through a front shaft support or head assembly 111, a guide housing 113, a universal link 115 and a rear shaft support 117. The drilling system 103 is a conventional system that can rotate the shaft clockwise as seen from the rear looking forward while pushing the shaft 101 forward for drilling purposes and it can also pull the shaft rearward. Additional stem members can be attached to the rear 101R of the shaft 101 and to the drilling system 103 as the hole being drilled gets longer or deeper. The shaft 101 can rotate within each of units 111, 113, 115, and 117, and can move forward and rearward relative to units 113, 115, and 117. The units 111, 113, 115, and 117 cannot rotate relative to each other but can roll together about the shaft 101 if means is not provided for preventing the roll. Unit 111 can be moved longitudinally by the shaft 101 rearward a small distance to a shifting position relative to unit 113 and forward a small distance to a drilling position relative to unit 113 as shown in FIG. 1 and 2.

Ball joints at the rear of unit 111 and at the front of unit 113; at the rear of unit 113 and at the front of unit 115; and at the rear of unit 115 and at the front of unit 117 allow unit 113 to swivel relative to unit 111, unit 113 to swivel relative to unit 115 and unit 115 to swivel relative to unit 117 for turning purposes. Units 111 and 117 remain concentric with the shaft 101 at all times including when the apparatus is turning.

Figure 2:
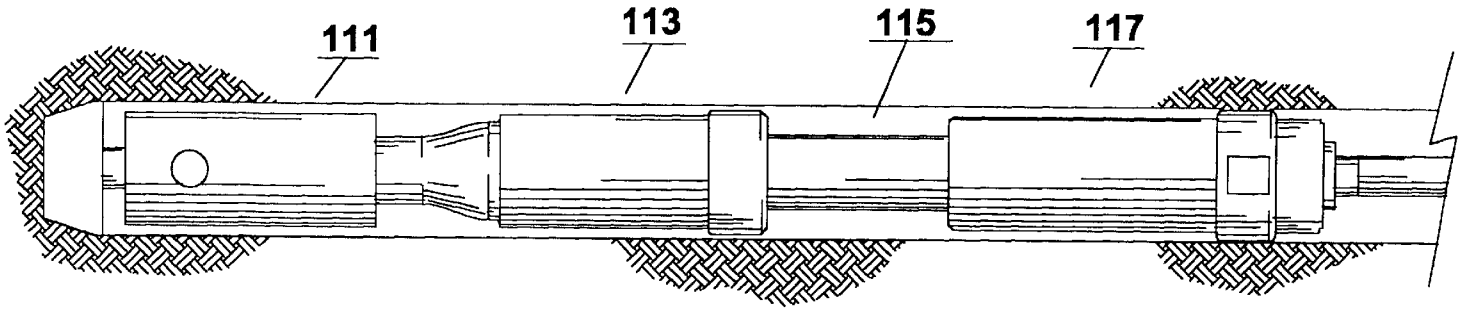
FIG. 2 illustrates the drilling apparatus of the invention in a straight drilling mode.

A cam means or system and a cam follower are employed in unit 113 to cause the apparatus to drill straight as shown in FIG. 2 or to tilt unit 113 relative to the shaft 101 as shown in FIGS. 6A, and 31–34 to cause the unit 111 and hence the apparatus to turn up, down, left or right or any fraction thereof while drilling operations are being carried out.

Referring to FIGS. 3, 4, 6A, and 16–19, the drill bit 105, two driving gears 121 and 123 and a sprocket 125 are coupled to the shaft 101 such that they cannot rotate or move longitudinally relative to the shaft 101. They rotate and move longitudinally with the shaft as it is rotated or moved longitudinally. The bit 105, the gears 121 and 123 and the sprocket can be replaced when worn or to change bit sizes. The drill bit 105 will have an outside diameter greater than the outside diameters of each of units 111, 113, 115, and 117.

Figure 20:
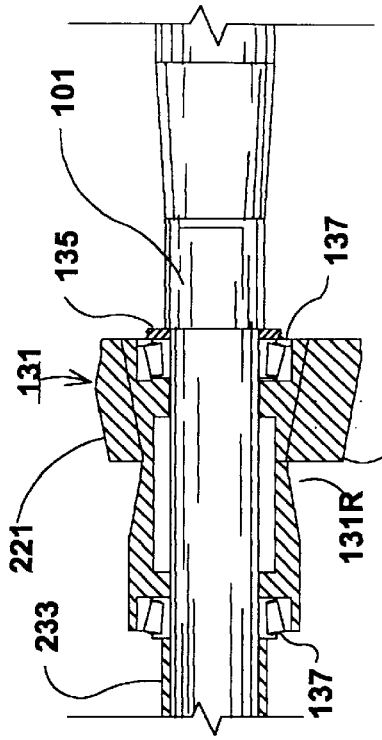
FIG. 20 illustrate the double cam follower mounted on the shaft.
Figure 27:
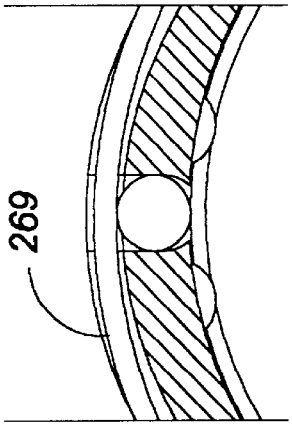
FIG. 27 illustrate the ball of FIG. 25 between notches of the sprocket.
Figure 26:
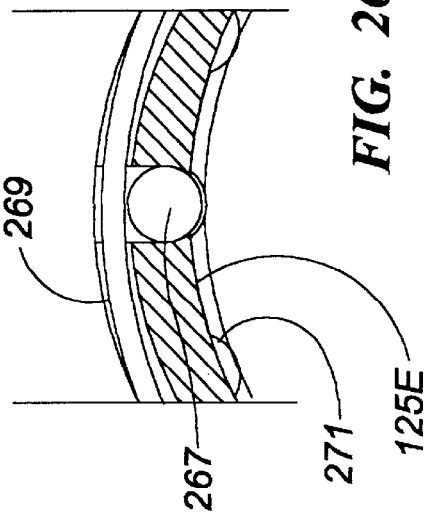
FIG. 26 illustrate one of the balls of the clutch in a notch of the sprocket.
Figure 30:
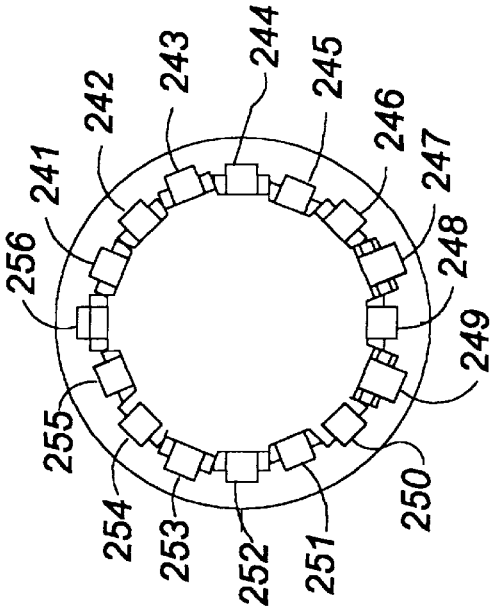
FIG. 30 illustrate the 16 cams of the apparatus.
Figure 28:
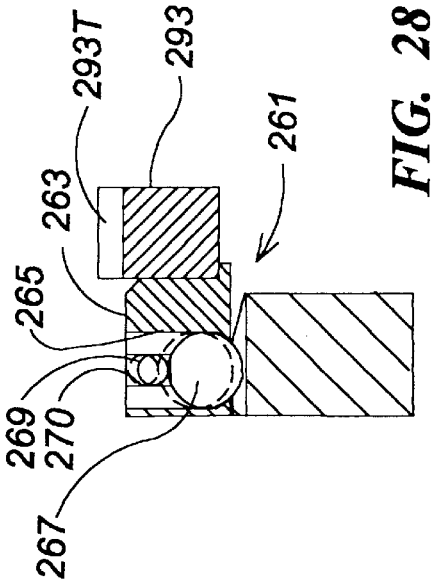
FIG. 28 is an enlarged a cross-section of FIG. 26.

Referring to FIG. 20, there is provided a cam follower 131 coupled to the shaft 101 which can rotate about the shaft but cannot move longitudinally relative to the shaft. Longitudinal movement on the shaft is prevented by members 133 and 135. Members 137 are bearings. The front shaft support 111 cannot move longitudinally relative to the shaft 101 but the shaft 101 can rotate within the support 111. The shaft 101 can move longitudinally within the rear shaft support 117 and can rotate within the support 117.

Referring to FIGS. 21–23, there is provided a cam ring 141 which is fixed in the guide housing 113 and cannot rotate or move longitudinally within the guide housing. Also located in the guide housing is a cam follower housing 151 which is fixed longitudinally within the guide housing 113 but can be rotated within the guide housing.

Figure 3:
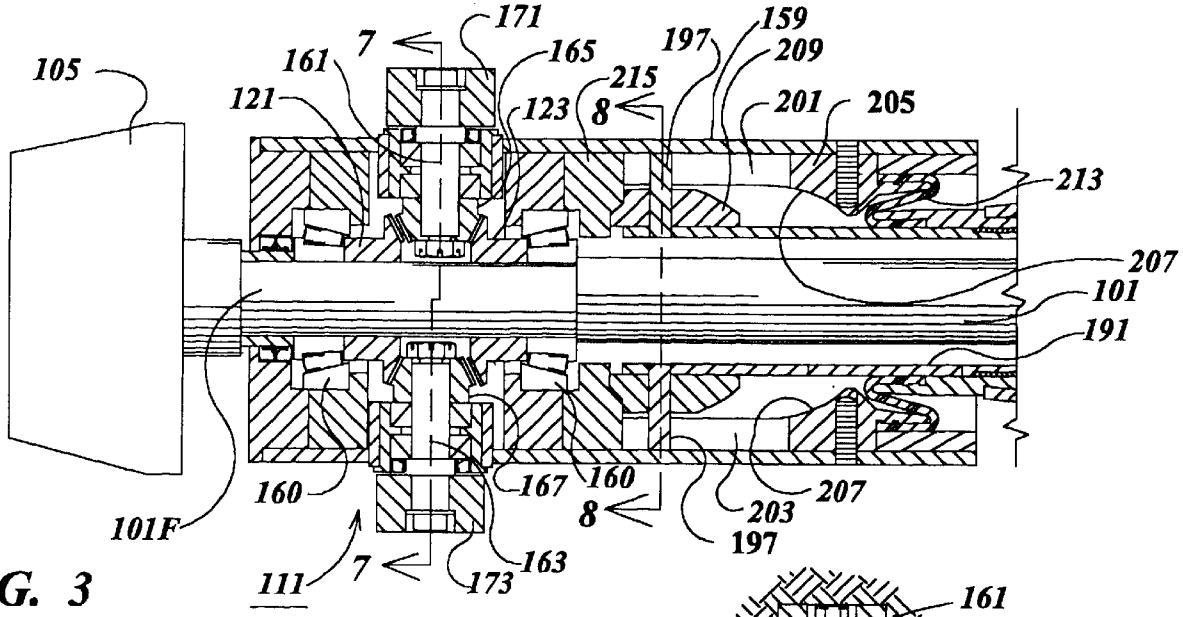
FIG. 3 is a cross-sectional view of FIG. 1 taken along the lines 3—3 thereof.
Figure 7:
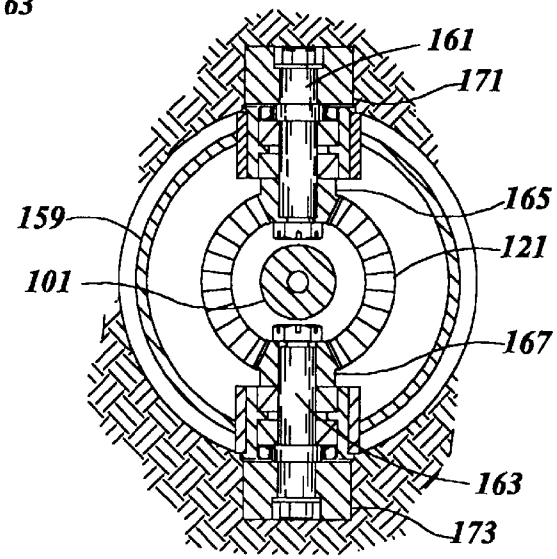
FIG. 7 is a cross-sectional view of FIG. 3 taken along the lines 7—7 thereof.
Figure 8:
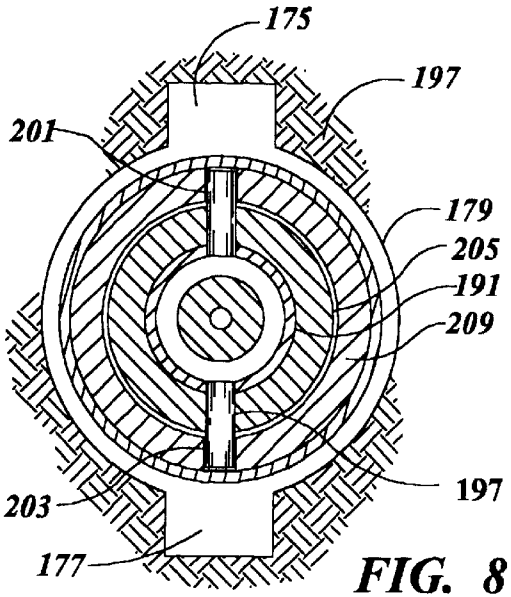
FIG. 8 is a cross-sectional view of FIG. 3 taken along the lines 8—8 thereof.
Figures 5, 12, 13, 35:
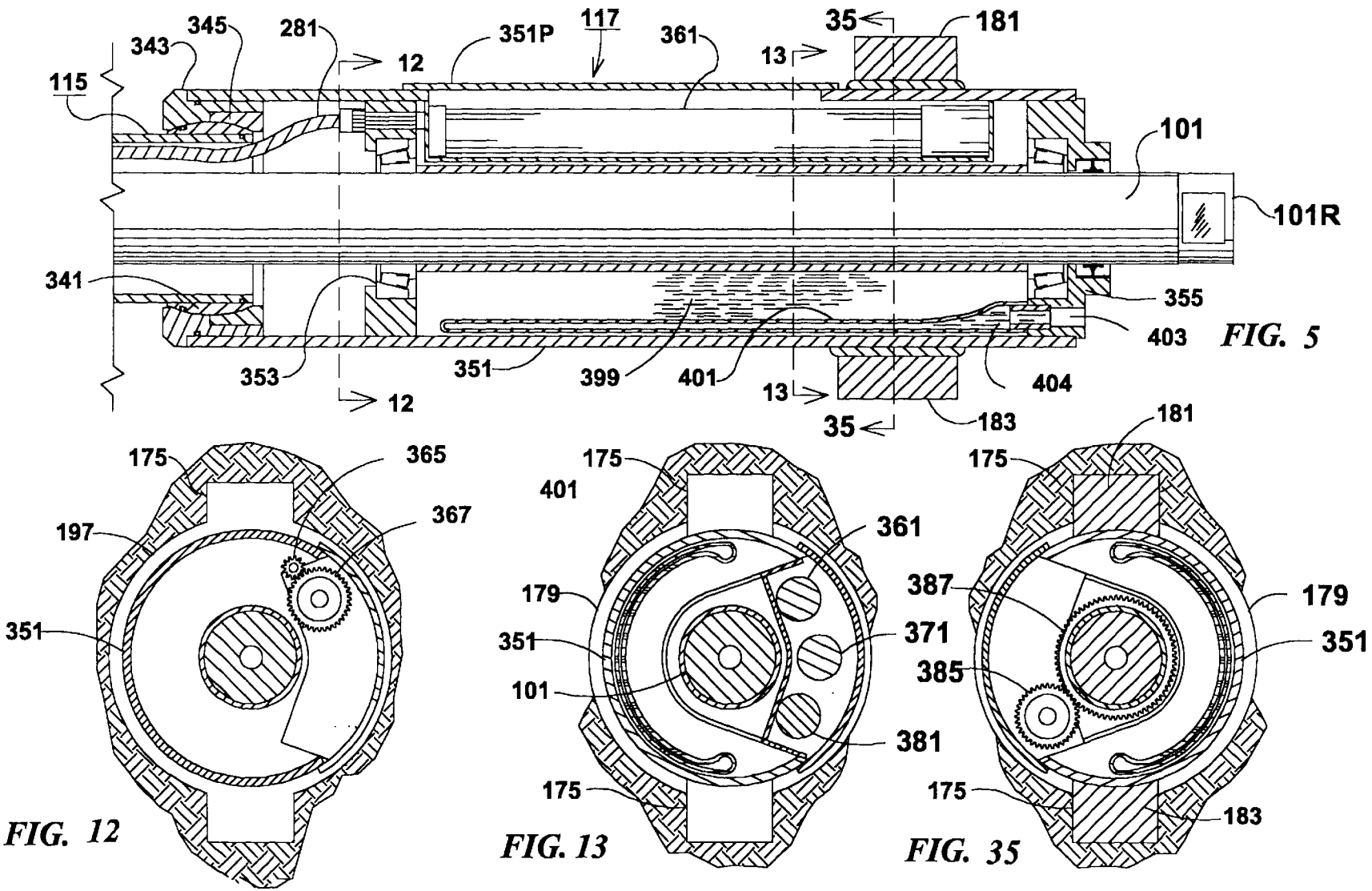
FIG. 5 is a cross-sectional view of FIG. 1 taken along the lines 5—5 thereof.
FIG. 12 is a cross-sectional view of FIG. 5 taken along the lines 12—12 thereof.
FIG. 13 is a cross-sectional view of FIG. 5 taken along the lines 13—13 thereof.
FIG. 35 is a cross-section of FIG. 5 taken along the lines 35—35 thereof.

Referring to FIGS. 3, 7, and 8, the front shaft support 111 comprises a cylindrical tube 159 which has structure for supporting bearings 160 and two side shafts 161 and 163 having gears 165 and 167 connected to the inner ends of the shafts 161 and 163 respectively and side cutters 171 and 173 connected to the outer ends of the shafts 161 and 163 respectively. Gears 165 and 167 mesh with gears 121 and 123 such that rotation of the shaft 101 causes gears 165 and 167 to rotate and hence the side cutters 171 and 173 to rotate. When the shaft 101 is rotated clockwise, as seen from the rear end 101R of the shaft 101 looking toward the front end 101F for drilling purposes, the bit 105 rotates and the side cutters 171 and 173 rotate. The purpose of the side cutters 171 and 173 is to cut side holes 175 and 177 which are transverse to the axis of the borehole 179 being drilled for receiving roll stabilizers 181 and 183 coupled to the rear shaft support 117, as shown in FIG. 5, to prevent the units 111, 113, 115, 117 from rolling around the shaft 101 as the hole 179 is being drilled.

An inner tube 191 is slidably located in the housing tube 159 and has its rear end connected to a tubular member 193. (Note FIG. 4) The rear end of the tubular member 193 increases in diameter and is connected to the front end of the tube 195 of the guide housing 113 such that the tubular members 191, 193, and 195 are fixed together and cannot rotate relative to each other or move longitudinally relative to each other. Two slide pins 197 are fixedly coupled to the front end of the inner tube 191 and can slide forward and rearward within slots 201 and 203 formed in a stop ring 205 fixed to the inside of tube 159. The ring 205 deceases in diameter rearward to form a stop ball socket 207 in which an annular guide stop ball 209 can slide. The guide stop ball 209 is fixedly connected to the inner tube 191 and to pins 197. Fixedly connected to the inside of the rear end of the tube 159 is the front end of a flexible sleeve 213. The rear end of the sleeve 213 is connected to the front end of the tube 191.

In the position of the shaft 101 as shown in FIGS. 3 and 4, the front housing 111 and hence the tube 159 are in a rearward position relative to the guide housing 113 and the front housing 111 is stopped or prevented from going further rearward by engagement of the ring structure 215 with the front end of the stop ball 209. In this position, the sleeve or boot seal 213 is folded. The shaft 101 can move the front housing 111 forward relative to the guide housing 113 until the rear end of the stop ball 209 engages the rearward smaller diameter portion of the socket 207 of the ring 205 as shown in FIG. 6A. In this position, the front end of the sleeve 213 is moved forward as shown in FIG. 6A. The rear end of the stop ball 209 and the smaller diameter portion of the tube 205 are rounded in convex and concave shapes and mate with each other such that when the shaft 101 and the front housing are in the forward drilling position, the front housing 111 and the guide housing 113 can swivel relative to each other to allow the drilling apparatus to turn.

Referring to FIGS. 4, 6, 9–11, 14, 15, 16, 18, 20–30, the guide housing 113 comprises the tube 195, the follower housing 151, the cam ring 141, the double cam follower 131 and the sprocket 125 as disclosed above. The double cam follower 131 comprises two members 221 and 223 located 180 degrees apart and extending radially from a central ring 131 R which can rotate about the shaft 101. The cam follower housing 151 comprises two slots 231 and 233 in which the cam members 221 and 223 can slide forward or rearward when the shaft 101 is moved forward or rearward relative to the tube 195 of the guide housing 113 for drilling or shifting purposes. The cam ring 141 has 16 cams or cam surface adapted to be engaged by the cam member 223.

Figure 33:
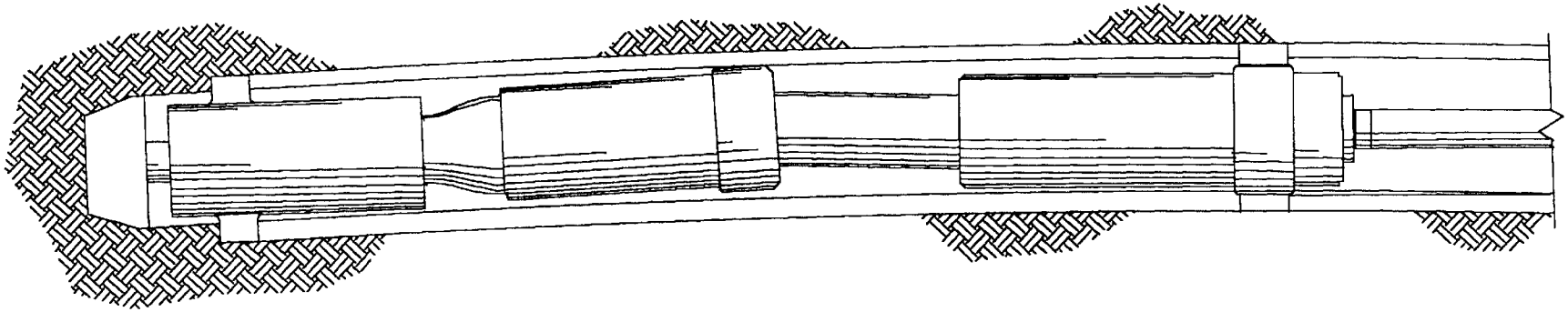
FIG. 33 illustrates the apparatus in a borehole in a left turning position.
Figure 34:
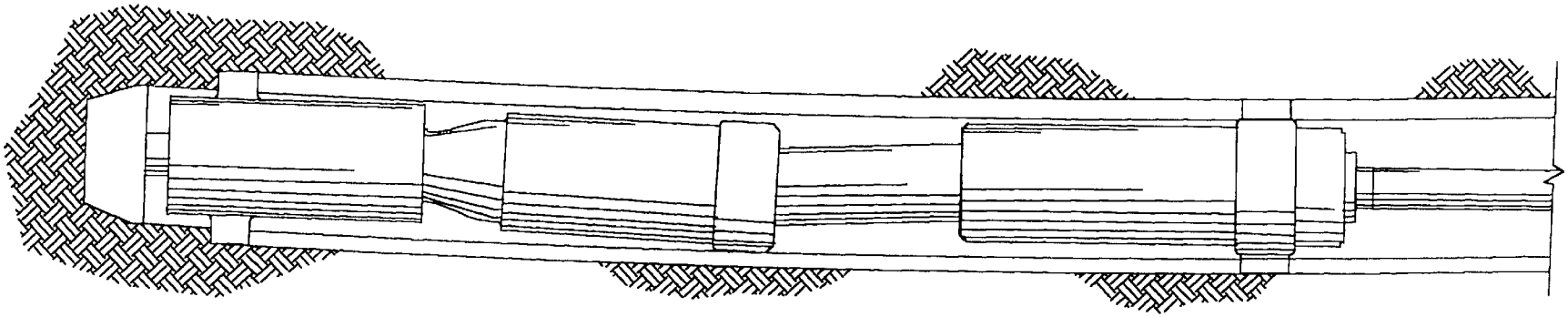
FIG. 34 illustrates the apparatus in a borehole in a right turning position.
Figure 37:
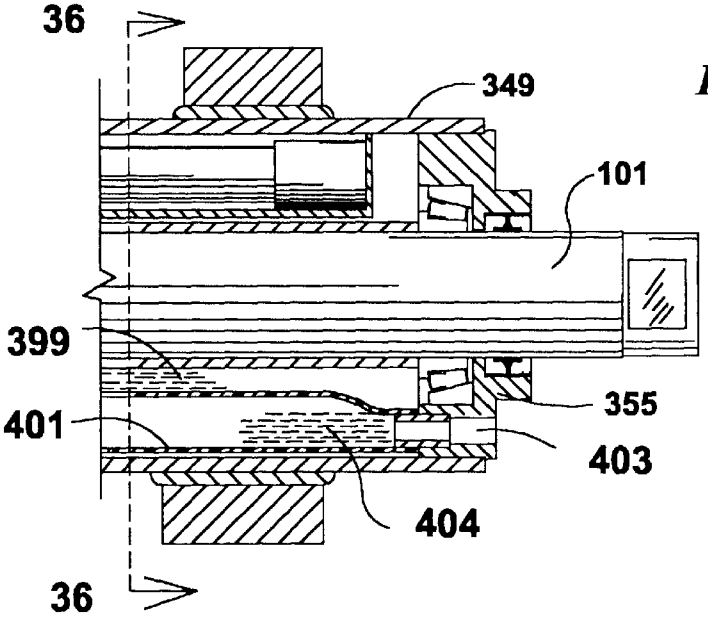
FIG. 37 is a partial cross-section of the rear shaft support showing the bladder of FIGS. 35 and 36.
Figure 36:
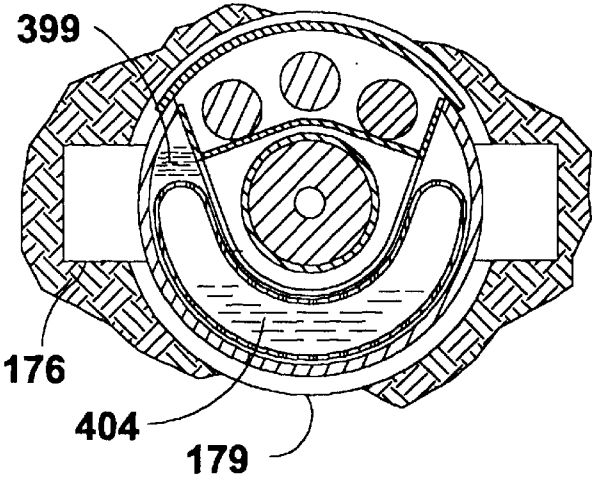
FIG. 36 is a view similar to that of FIG. 35 but with the bladder full of water and expanded.

Cam member 221 is employed for guide purposes only and does not engage the cams. Only the cam member 223 engages a selected cam for controlling the tilt of the guide housing 113 relative to the axis of the shaft 101. Either of cams 241 or 255 is employed to maintain the guide housing 113 concentric relative to the axis of the shaft 101 when engaged by the cam member 223 for drilling straight. The cams 241 and 255 have little or no incline. The other cams 256 and 242–254 are employed to cause the guide housing 113 to tilt relative to the axis of the shaft 101 when engaged by the cam member 223. Cams 243, 247, 249, 253 and 256 have the same amount of slant or incline relative to the axis of the guide housing 113 which is defined as a small incline. Cams 242, 244, 246, 250, 252 and 254 have the same amount of incline which is defined as a medium incline. Cams 245, 248, and 251 have the same amount of incline which is defined as a large incline. The amount of tilt in which the guide housing is moved relative to the axis of the shaft depends on which cam is selected for engagement by the cam member 223 for titling purposes. When the desired cam is selected, the shaft 101 is pushed forward relative to the guide housing 113 and the cam member 223 is pushed forward with the shaft to fully engage the selected cam ramp. This causes the guide housing 113 to tilt relative to the axis of the shaft 101 and pushes the rear end of one side of the guide housing against one side of the borehole wall causing the drill head to be forced in a direction opposite the direction in which the rear end of the guide housing is forced. For example in FIG. 31, the rear end of the guide housing is forced against the upper side of the borehole, forcing the front housing 111 downward to cause drilling to turn downward. An opposite turn is up in FIG. 32. In FIG. 33, the rear end of the guide housing is forced against the right wall of the borehole, forcing the front housing 111 to the left to cause drilling to turn to the left. An opposite turn from that of FIG. 33 is shown in FIG. 34.

Except for the cams 241 and 255, in this embodiment, all of the cams may have the same incline.

Figure 15:
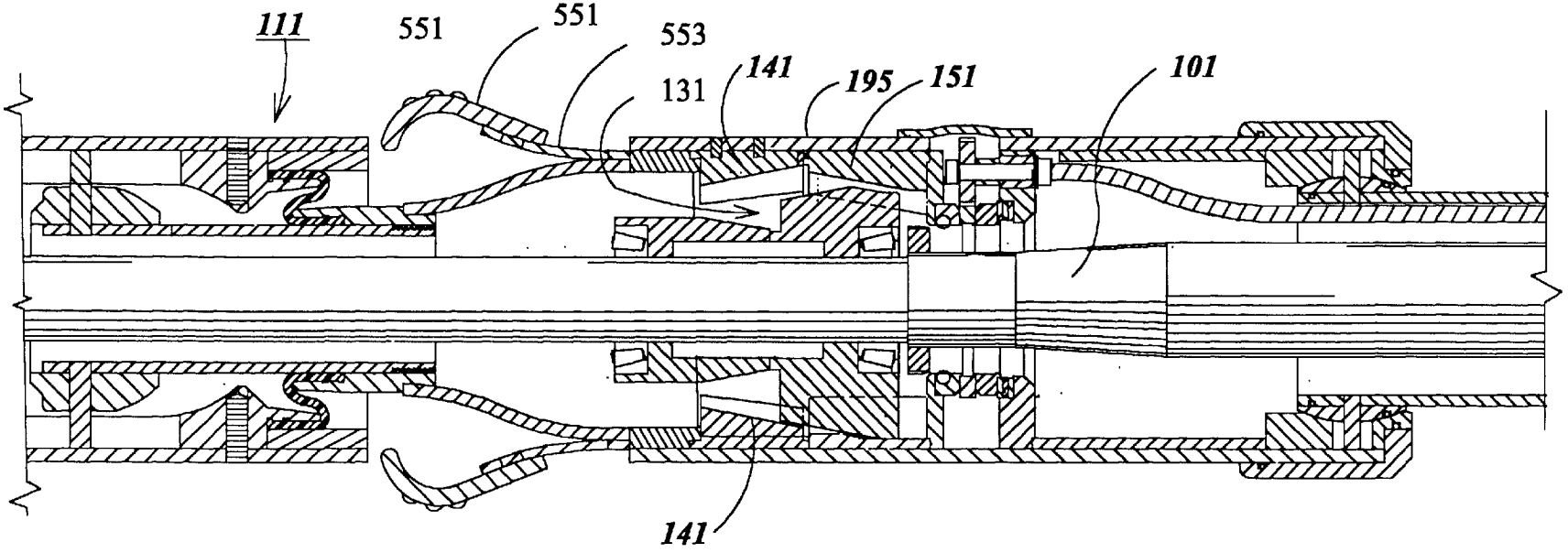
FIG. 15 is a cross-sectional view of the apparatus similar to that of FIG. 4 but with the clutch in a released position.
Figure 19:
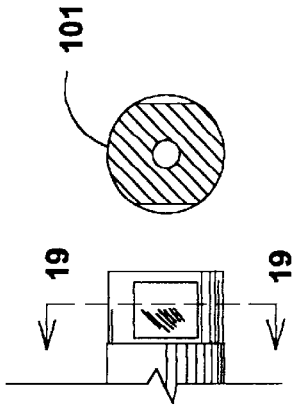
FIG. 19 is a cross-section of FIG. 16 taken along the lines 19—19 thereof.
Figure 16:
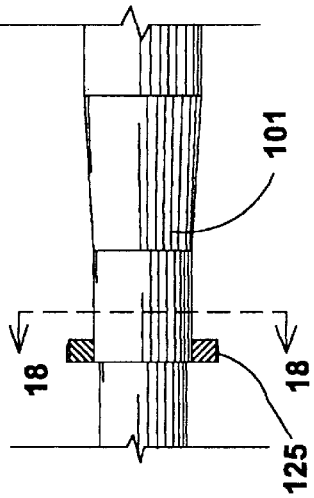
FIG. 16 illustrate the drill bit, the driving gear and the sprocket fixed to the shaft.
Figure 18:
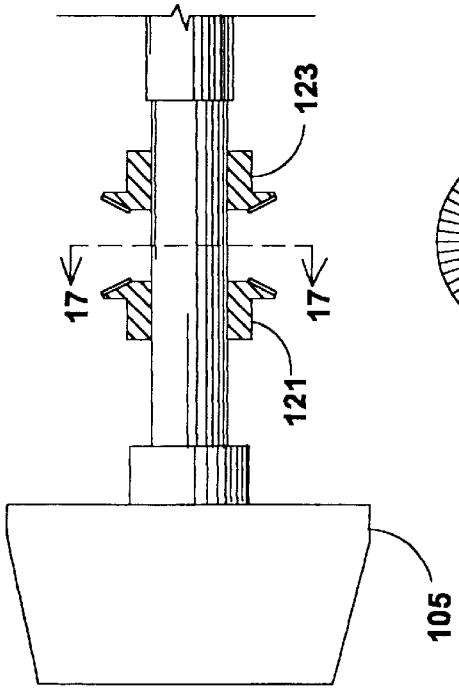
FIG. 18 is a cross-section of FIG. 16 taken along the lines of 18—18 thereof.
Figure 18:
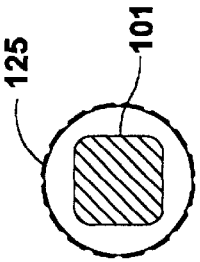
Figure 17:
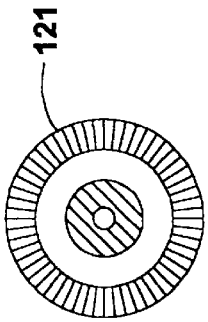
FIG. 17 is a cross-sectional of FIG. 16 taken along the lines 17—17 thereof.

Referring to FIGS. 26–29, there will be described the mechanism for allowing the cam follower 131 and its cam member 223 to be shifted from one cam to another cam. Attached to the rear of the cam follower housing 151 is a ball ring 263 which operates in conjunction with the sprocket 125 to form a clutch 261 to allow shifting to take place. The annular ball ring 263 has two apertures 265 formed radially through the ring 263, 180 degrees apart. Located in each of the apertures 265 is a steel ball 267 which is biased radially inward by a spring 269 located in a slot 270 above each aperture 265. The sprocket 125 comprises an annular member having 16 slots 271 formed in its outer edge 125E. The centers of adjacent slots form an angle of 22.5 degrees. When the shaft 101 and the front shaft support 111 are in a forward drilling position as shown in FIG. 6, the sprocket 125 is located forward of the ball ring 263. When cam member 223 fully engages a cam, the rear ends of both cam members 221 and 223 are still located in the slots 231 and 233 of the follower housing 151 preventing the housing 151 from rotating within the guide housing 113. When the shaft 101 and the front shaft support 111 are moved rearward, the sprocket 125 moves rearward whereby the balls fall into two slots 271 which lock the balls 267 and hence the follower housing 151 to the sprocket 125. If the balls are initially located between adjacent slots 271 they will be pushed radially outward by the sprocket as it moves rearward, and rotation of the shaft 101 and sprocket 125 by the drill system 103 will enable the balls to fall into two opposite slots. In this position, the cam members 221 and 223 are completely disengaged from the cams and rotation of the shaft 101 and sprocket 125 will cause the cam follower housing 151 and its cam members 221 and 223 to rotate relative to the cams. The operator, then can rotate the shaft 101 with the system 103 to position the cam member 223 adjacent to a selected cam and cause the system 103 to push the shaft 101 forward to release the sprocket 125 from the ball ring 263 and to push the cam members 221 and 223 to a drill position to allow cam 223 to fully engage the selected cam. FIG. 15 shows the position of the sprocket 125 as is moved forward an amount sufficient to be released from the ball ring 263 with the cam follower members 221 and 223 just entering the cam ring 141. At the drill position, the rear ends of the cam members 221 and 223 are still in the cam follower slots 231 and 233 and prevent rotation of the cam follower 151 housing.

Referring also to FIGS. 1, 4, 5, 12, 13, and 39, a monitoring system is provided for monitoring the angular position of the cam follower to enable the operator above ground to monitor the shifting position while rotating the shaft 101 which is attached to the cam follower. The system comprises a conventional flexible cable 281 having a flexible cable shaft connected to the shaft 289 of a gear 291 having teeth 291T which mesh with the teeth of a gear 293 which is connected to the ring 263. The shaft 289 of the gear 291 is supported for rotation by a bearing and sleeve 295 which is connected to the inside of the tube 195 of the guide housing 113. The cable 281 extends to a cam follower sonde 361 located in the rear shaft support housing 117 which sends a wireless signal to a monitor 421 located at the surface. This makes it possible to select any cam or shifting position by rotating the shaft 101 while watching the above ground monitor 421.

Referring to FIGS. 4, 5, 6A, 12, and 13, the universal link 115 comprises a tubular member having an annular member 321 with a convex surface, secured to its front end by way of rods 323, located in annular members 327 and 329 secured to the inside of the rear of tubular member 195 of the guide housing 113. The members 327 and 329 have concave surfaces which mate with the convex surface of annular member 321 to form a ball joint for connecting members 195 and 115 together to allow the two members 113 and 115 to swivel relative to each other as shown in FIGS. 31–34. An annular member 341 with a convex surface is secured to the rear end of tubular member 115 which mates with a concave surface formed on members 343 and 345 secured to the inside of the rear end of a tubular member 351 of the rear shaft support 117 to form a ball joint which allows the members 115 and 117 to swivel relative to each other as shown in FIGS. 31–34.

Bearing members 353 and 355 support the shaft 101 for rotation within the rear shaft support 117. Located in the rear shaft support 117 are a cam follower sonde 361 and a housing roll sonde 371. The cable 281 is connected to a rear cable gear 365 which meshes with a shifting sonde gear 367 to turn the sonde 361 in the same direction and the same amount in degrees as the cam follower 131 is rotated by the shaft 101 during the shifting procedure as described previously. The sonde 361 contains a battery and a wireless transmitter which transmits wireless signals to the surface monitor 421, the rotational position of the sonde 361, the longitudinal tilt of the sonde 361 and the depth of the sonde 361. Also located in the shaft support 117 is a housing level sonde 371 which also includes a wireless transmitter and battery. The sonde 371 transmits to the same monitor 421, a wireless signal which includes information of the rotary position of the rear housing support 117 and thus the cam ring, its tilt, and its depth. The wall of the tube 351 at 351P is of a material, such as plastic that will allow transmission of the signals.

The sondes 361 and 371 and monitors 421 and 423 are conventional units commercially available from Radiodetection Ltd. of Bristol, U.K. and identified as RD385L. These devices also are disclosed in U.S. Pat. Nos. 5,469,155 and 3,617,865 which are incorporated into this application by reference.

Figure 29:
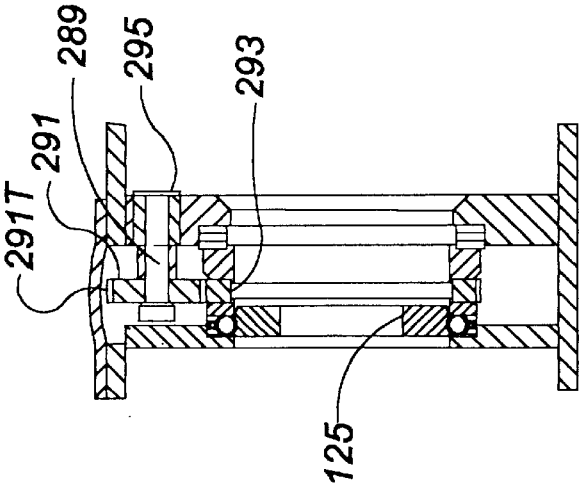
FIG. 29 illustrate the sprocket and ball ring of the clutch of the invention.
Figure 31:
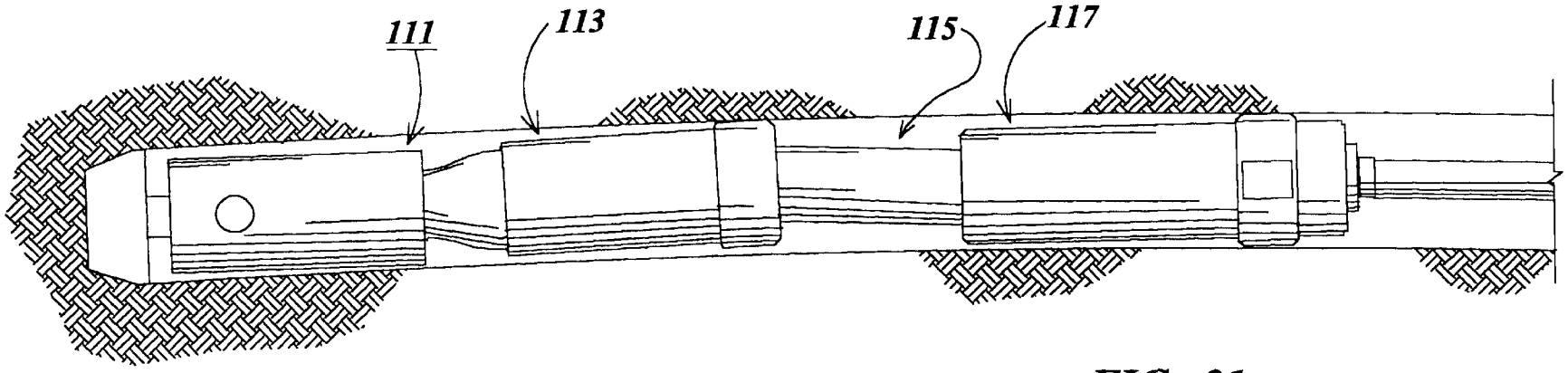
FIG. 31 illustrates the apparatus in a borehole in a downward turning position.
Figure 32:
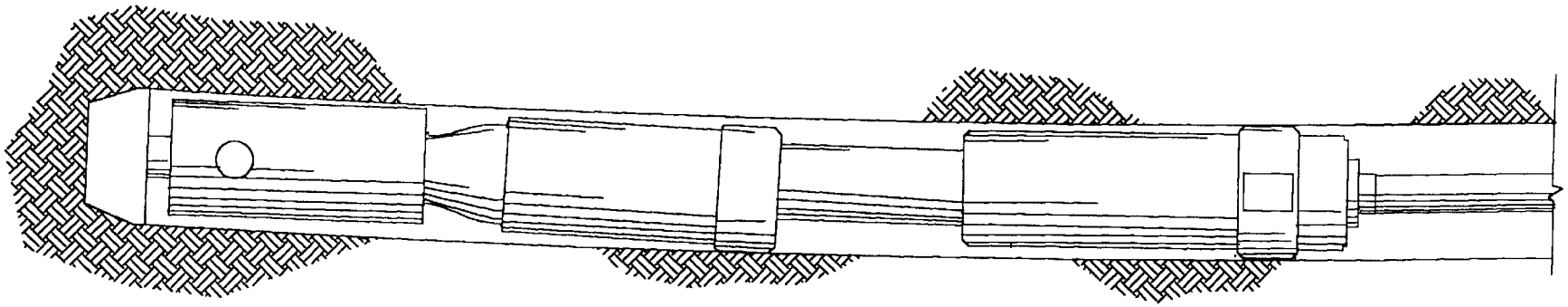
FIG. 32 illustrates the apparatus in a borehole in an upward turning position.

The follower housing 151 is the central part of the shifting and operating system. Referring to FIG. 23, there are two opposing cams 231C and 233C in the follower housing 151 that work with the double sided cam follower 131 to align the guide housing 113 to a position concentric with the shaft 101, when the shaft 101 is pulled into the shifting position. There are side guides 231G and 233G for the cams 231 C and 233C in the follower housing 151 that keep the center line of the follower housing 151, the center line of the shaft 101 and the center line of the guide housing 113 at a common axis when in a shifting position. Referring to FIG. 29, there is a gear 293 mounted on the rear of the follower housing 151 that is a part of a gear and flexible cable system, that causes the cam follower sonde 361 to rotate in the same direction and to the same angle as the cam follower. This allows the above ground apparatus to indicate the shifting position.

The spring loaded ball ring 263 of clutch 261 is connected to the rear of the cam follower housing. The two balls 267 of the clutch work with the clutch sprocket 125 fixed to the shaft 101 to connect the follower housing 151 to the shaft 101 when in the shifting position. This makes it possible to select any shifting position by rotating the shaft 101 while watching the above ground monitor.

When the shaft 101 is pushed forward into the drilling position, the follower 131 engages the cam ring 141, and since the rear of the follower 131 always remains engaged with the follower housing 151, this locks the guide system rotational to the guide housing 113 and releases the ball clutch 261 allowing the shaft 101 to be free of the guide system in order to rotate the drill bit.

Figure 39:
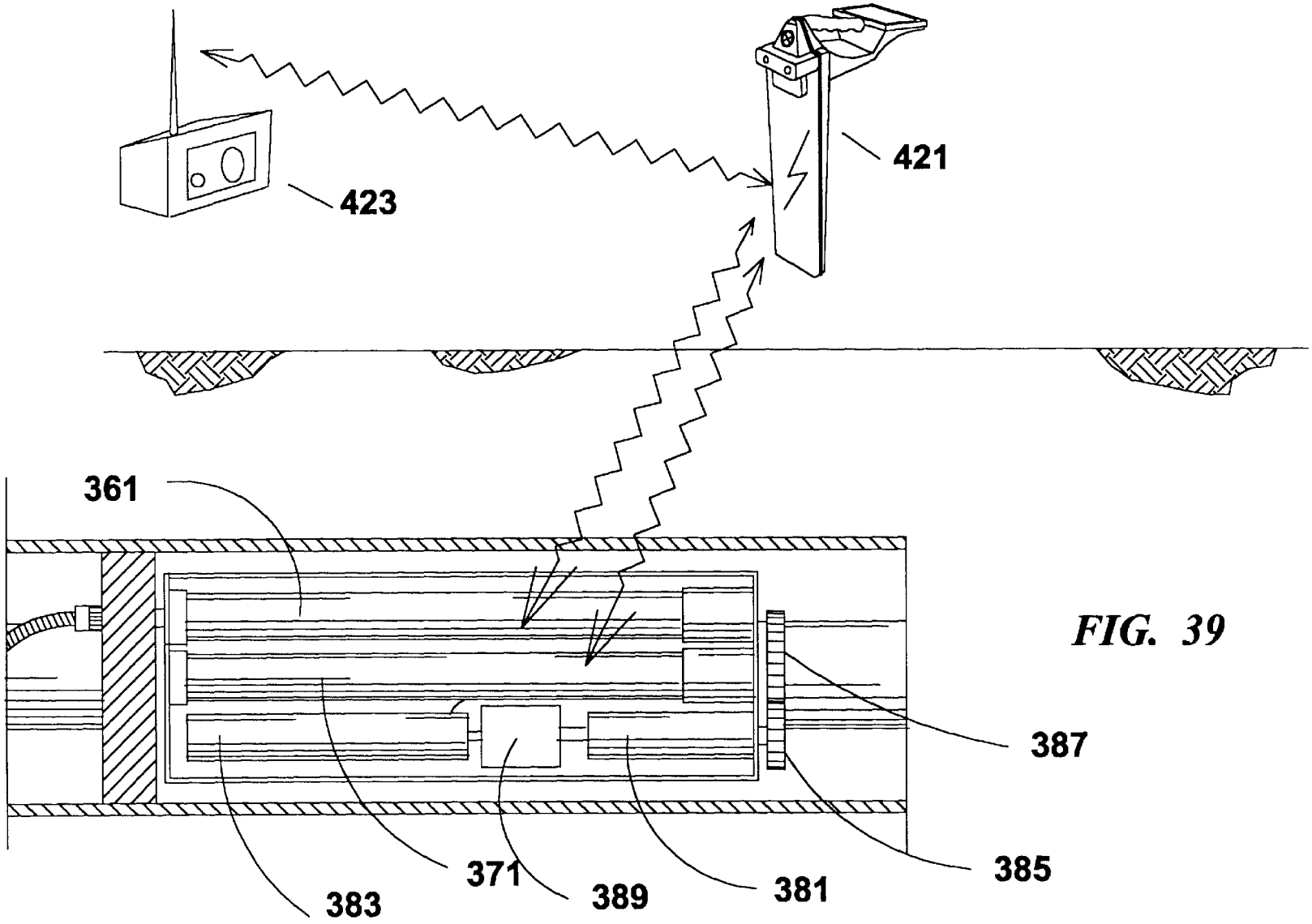
FIG. 39 illustrates an electrical power system employed in the rear shaft support.

Referring to FIGS. 13, 35, and 39 there is disclosed a generator 381 rotated by the shaft 101 for charging the batteries 383 used to provide electrical power to the sondes 361 and 371. The generator 381 has a gear 385 which meshes with a gear 387 connected to the shaft 101 such that as the shaft 101 rotates, it rotates the generator 381 by way of gears 387 and 385 to produce an electrical output which is applied to a regulator 389 having an electrical output which is applied to maintain a charge on the batteries 383. The use of the generator avoids the problems of the batteries becoming discharged which requires the apparatus to be pulled out of the borehole to replace the batteries.

The insides of the three units 111, 113, 115, and 117 contain oil 399 and are in fluid communication with each other. As the shaft 101 and front support housing 111 move forward or rearward relative to units 113, 115, and 117 the volume in the units expand and retracts. Referring to FIGS. 13, 35, 36, and 37, a flexible bladder 401 is located in the unit 117 and has a passage 403 in fluid communication with water exterior of the unit 117 which is the borehole being drilled. Thus water 404 in the borehole used for lubrication purposes, etc. can flow into and out of the bladder 401 by way of the passage 403. The bladder allows for the variation in volume when the apparatus expands and retracts during shifting and for the variation in exterior water pressure without the need of high pressure seals. The volume of the oil is fixed. When the volume of the interior of the units 111, 113, 115, and 117 expands, as the unit 111 moves to the drilling position relative to unit 113, water flows into the bladder from the borehole by way of passage 403 to provide extra fluid in the units to compensate for the increase in volume. When the volume of the units 111, 113, 115, and 117 decreases as the unit 111 moves to the shifting position relative to unit 113, water flows out of the bladder 401 and into the borehole by way of passage 403. Thus the bladder 401 maintains an equal pressure between the oil in the apparatus and the exterior water thereby eliminating the necessity of high pressure seals and preventing a difference in interior and exterior pressure from shifting the shaft when shifting is not desired. In preparing the apparatus for use, when the shaft 101 is in the rearward shifting position and the bladder is collapsed, the units 111, 113, 115, and 117 are filled with oil. When the interior volume is expanded, water flows in the bladder to maintain the interior and exterior pressures equal.

Figure 38:
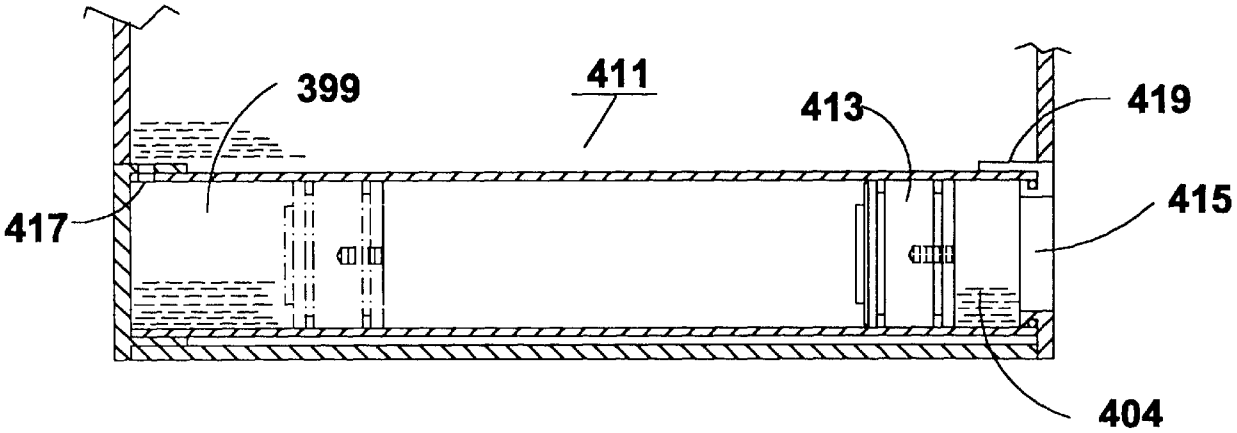
FIG. 38 illustrates a piston for compensating for the change in volume of the apparatus of the invention during the shifting operation.

Referring to FIG. 38, there is disclosed a cylinder 411 which takes the place of the bladder 401. The cylinder 411 has a floating piston 413 and a passageway 415 which leads to the exterior and a passageway 417 which leads to the interior of the housing. Water can enter the cylinder 411 on the right side of the piston 413 as shown in FIG. 38, and oil can enter the cylinder through passageway 417 on the left side of the piston 413. When filling the units 111, 113, 115, and 117 with oil, the piston 413 will be located close to the wall 419. As the interior volume expands, water enters the passageway 415 and oil flows from the cylinder 411 into the housing by way of the passageway 417.

Following is an example of using the subject directional control head (DCH) in boring a hole under a street. Assume that the minimum depth of the borehole under the street is to be 4 feet because a new electric conduit is being installed. At this depth, it is known from past experience that rock starts at 2 feet below the surface.

Surveying the Job

After a walk over and talking to all of the utility companies, it is determined that this situation is typical. It has a water line, a sewer line, a storm sewer, a telephone line and a gas line. The street is about a 120 feet wide.

Set Up

The system is set up about 30 feet from the edge of the street to have room to get down to the minimum depth by the time the apparatus bores to the street. The drill system is set up at an typical angle to horizontal of 23 points which means that the drill unit will start the lead stem in the ground in a way so as to be heading down at approximately 23 inches every ten feet.

Attaching the DCH to the Drill Unit

With the drill unit set up, the operator threads the rear end of the shaft of the DCH onto the lead drill stem which is attached to the drill motor that has the ability to rotate clockwise and counterclockwise and to travel forward and backwards.

The Indicator(s)

The operator changes the batteries in the rotational/depth/pitch indicator called a sonde(s) for short. Sondes are sold by several different companies. They all work about the same. The operator then places the sonde(s) into the DCH. The sonde transmits the information that it has via signals to a receiver that a worker , called a locator, carries above ground approximately overhead of the DCH. It has a range of approximately 25 feet. Thus the maximum depth is about 25 feet. Sondes of different strength can be used if the apparatus is to drill at deeper depths. There are two sondes in this DCH. One sonde is employed to locate the angular position of the cam follower and the other is used to locate the guide housing and thus the cam ring for locating the angular positions of the straight cams. The sondes will each produce different transmission frequencies. In this way, the receiver will be able to recognize each sonde signal. This also helps in the fact that sometimes a sonde of a certain frequency will have trouble in an area because of interference. The operator then calibrates the sondes to make sure that they will give a good reading.

Choosing a Drill Bit

The operator chooses a drill bit that will cut the rock the most efficient. He then threads it on to the front of the shaft that is passing through and is part of the DCH. This is what cuts the hole.

Beginning the Bore

The operator turns on the water which passes through the hollow drill stem and then through the hollow shaft of the DCH into the borehole by way of openings formed in the drill bit. The water is used to flush the cuttings away from the DCH, to cool the DCH, and to lubricate the borehole. The water returns by way of the space between the DCH and the wall of the borehole. In some cases water for lubrication purposes is not needed and hence the shaft 101 may be solid. Next the operator turns on the rotation mechanism and begins to thrust into the ground. The DCH is in a straight relation with the drill stem. This means the guide housing is not outside of the cutting radius of the drill bit. As the DCH starts into the ground, it may rotate but it does not matter since the housing sonde will keep track of how much it rotates.

Connecting Another Drill Stem

When the first drill stem is finished being drilled, the operator stops the thrust and rotation, shuts off the water, and unthreads the drill motor from the first stem. The operator then backs up the drill motor and attaches another stem. With two or more stems attached the whole stem assembly is known as a drill string.

Locating the DCH

The worker that is in charge of locating the whereabouts of the DCH takes a reading. At this point a decision is made to keep going as headed or to change the directions. The operator decides to continue a little further. Mid-way through this stem he checks the whereabouts of the head and decides to start leveling out.

The Shifting Sequence

The drill unit operator pulls back on the drill string. The shaft that passes through the DCH pulls back also. The DCH staying still allows the shaft to slide for about 2½ inches inside the DCH. The cam follower that is longitudinally locked to the shaft also slides with the shaft. This action pulls the cam follower out of the cam it had been in. Now the cam follower is free of the cam ring and can rotate independent of the cam ring. At the same time the cam follower becomes rotationally locked to the shaft via the clutch. This allows the drill unit operator to have control of the rotational location of the cam follower. The cam follower is geared to the first sonde. This allows the locator to watch and know the rotational location of the cam follower. Watching the monitor, on which the signal is displayed, the drill unit operator rotates the drill string which in turn rotates the cam follower. When the cam follower gets to the location that is needed, in this case straight down, the drill unit operator stops the rotation. The second sonde is checked to make sure that the cam that is about to be entered is a "straight cam". If it is, then the operator rotates the stem a very little amount to line up with the cam that is next to a "straight cam". This may not be the optimum direction but it is only a fraction of a revolution off and can be corrected if need be by going into the cam on the other side of a "straight cam". If it is not, then the drill unit operator pushes on the drill string disengaging the shaft from the cam follower rotationally and engaging the cam follower into the beginning of the cam that was chosen. As soon as the shaft is unlocked rotationally from the cam follower, it is rotated to start cutting the bore hole. The cam follower continues to engage further into the cam forcing the cam out away from the center of the shaft and since the cam is attached to the inside of the guide housing the guide housing is forced away from the center of the shaft and outside of the cutting radius of the drill bit. Contacting the wall of the bore hole the guide housing forces the drill bit in the opposite direction. In this case up.

Continuing the Bore

The operator can continue in this mode for as long as the operator feels it is necessary to achieve the goal. The operator can repeat the shifting sequence anytime to guide the drill bit to where he wants it to go.

Going Straight

There are two straight cams. When either of these cams is engaged by the cam follower, the guide housing will stay within the cutting radius of the drill bit having no effect on the direction of the DCH.

Going Any Direction

There are numerous cams around the radius of the DCH giving a choice to the operator as to which direction to travel.

Finishing the Bore

When the other side is reached, the DCH is removed and either the utility is installed or a back reamer is connected to the drill string and the bore hole is enlarged while pulling back the drill stem.

Referring to FIGS. 40–45, there is disclosed another embodiment of the invention employing a single housing. In FIGS. 40–45 like reference numerals identify the same components as identified in FIGS. 1–39. In this respect the embodiment of FIGS. 40–45 comprises the shaft 101 and drill bit 105 supported for rotation in a tubular housing guide 451 and for longitudinal movement relative to the housing 451. The embodiment also includes the cam follower housing 151 supported for rotation in the housing 451 and the cam follower 131 with the cam members 221 and 223 supported for rotation about the shaft 101. The cam follower housing 151 cannot move longitudinally relative to the housing 451 and the cam follower 131 cannot move longitudinally relative to the shaft 101. The shaft 101 can move longitudinally relative to the housing 451 to a forward drilling position and to a rearward shifting position. Connected to the shaft 101 is the sprocket 125 and connected to the rear of the cam follower housing 151 is the ring 263 with the spring biased balls 267 for engaging the sprocket 125 when the shaft is in a shifting position and for disengaging the sprocket 125 when the shaft 101 is in a drilling position. A cam means 461 is provided which is fixed to the housing 451 and cannot rotate in the housing or move longitudinally in the housing. The cam means 461 comprises a conical shaped inner surface 463 with two stops 465, 180 degrees apart formed on the interior of the surface 463 spaced forward a small amount relative to the rear end 461RE of the device 461.

In the shifting position of the shaft 101, the cam members 221 and 223 do not engage the cam device 461 and the follower housing 151 is connected to the shaft 101 by way of the clutch 261 comprising the ball ring 263 and balls 267 and sprocket 125 such that rotation of the shaft 101 will rotate the cam follower housing 151 angularly relative to the cam means 461. At the desired angular position, the shaft is moved forward to release the balls 267 from the sprocket 125 and to cause the cam member 223 to engage the cam surface 463 to tilt the housing 451 relative to the axis of the shaft 101 for turning purposes or to engage the stop 465 to maintain the housing 451 concentric with the shaft 101. The stops 465 are spaced forward of the rear end 461RE of the means 461 far enough to allow the ring balls 267 to be released from the sprocket 125 and to prevent the cam member 223 from causing the housing 451 to tilt relative to the shaft 101. It is to be understood that the cam means 461 may be used in the embodiment of FIGS. 1–34 in lieu of the cam ring 141 with its plurality of separate cams and vice versa.

The arrangement for allowing the shaft 101 to rotate in the housing 451 and the housing 451 to tilt relative to the shaft 101 comprises a ball joint 471 formed at the front of the housing 451 and a flexible support 491 formed at the rear of the housing 451. The ball joint 471 comprises annular support structure 473 connected to the inside of the housing 451 having an annular concave surface 475 which mates with an annular convex surface 477 of structure 479 which supports bearings 481 for allowing the shaft 101 to rotate in the housing 451 and to move longitudinally relative to the housing 451. The housing 451 can tilt relative to the shaft 101 at the ball joint surfaces 475 and 477. At the rear end, annular structure 493 is connected around the shaft 101 with an annular flexible member 495, C-shaped in cross-section, having its radially inner end connected to the member 493 and its radially outer end connected to the inside of the housing 451 to allow the rear end of the housing 451 to tilt relative to the shaft 101. Tubular guides 495 are connected to the member 493. Rods 497 are connected to the inside of the housing 451 and extend into the members 497 and act as radial guides as the housing 451 tilts relative to the shaft and limit longitudinal movement of the member 493 in the forward and rearward direction. The shaft 101 can rotate within member 493 and move forward and rearward through member 493 for shifting purposes. A seal is formed between the member 493 and the shaft 101.

Figure 40:
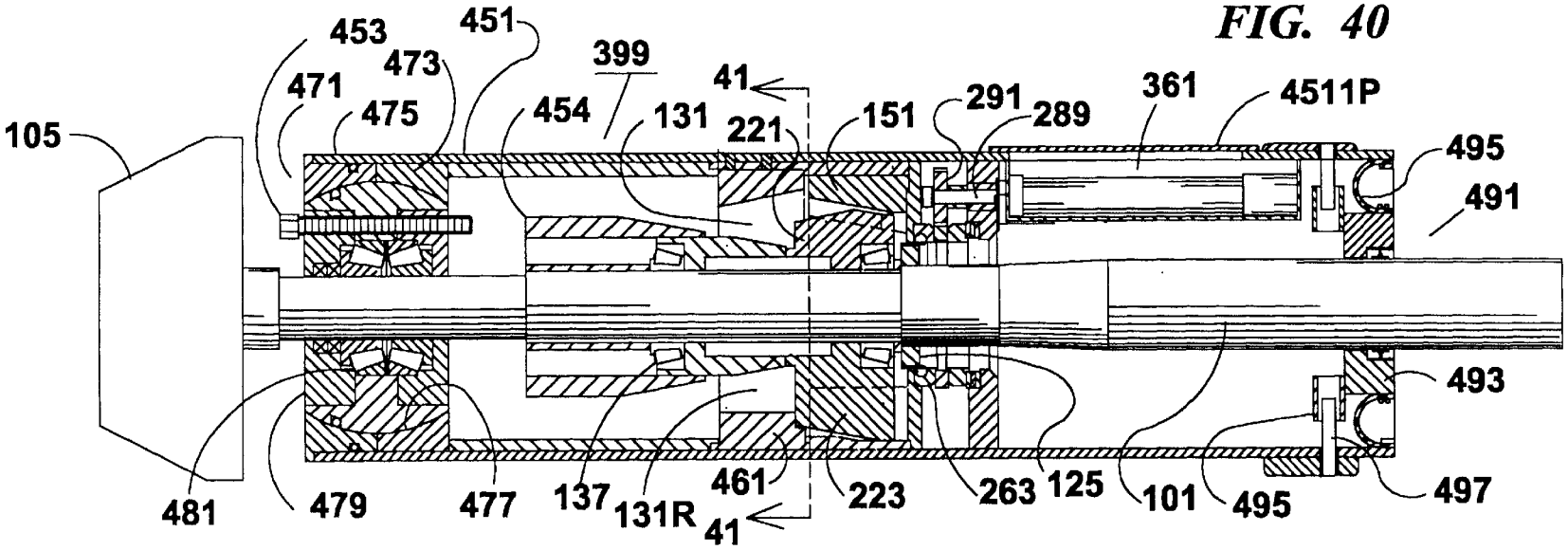
FIG. 40 is a cross-section of another embodiment of the invention.
Figure 41:
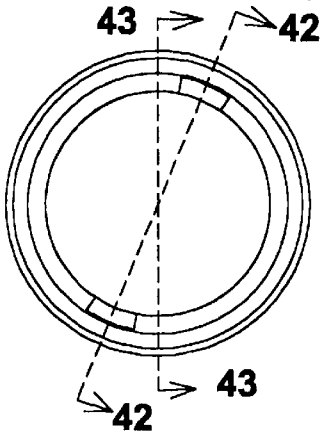
FIG. 41 is a cross-section of the cam of the apparatus of FIG. 40.
Figure 45:
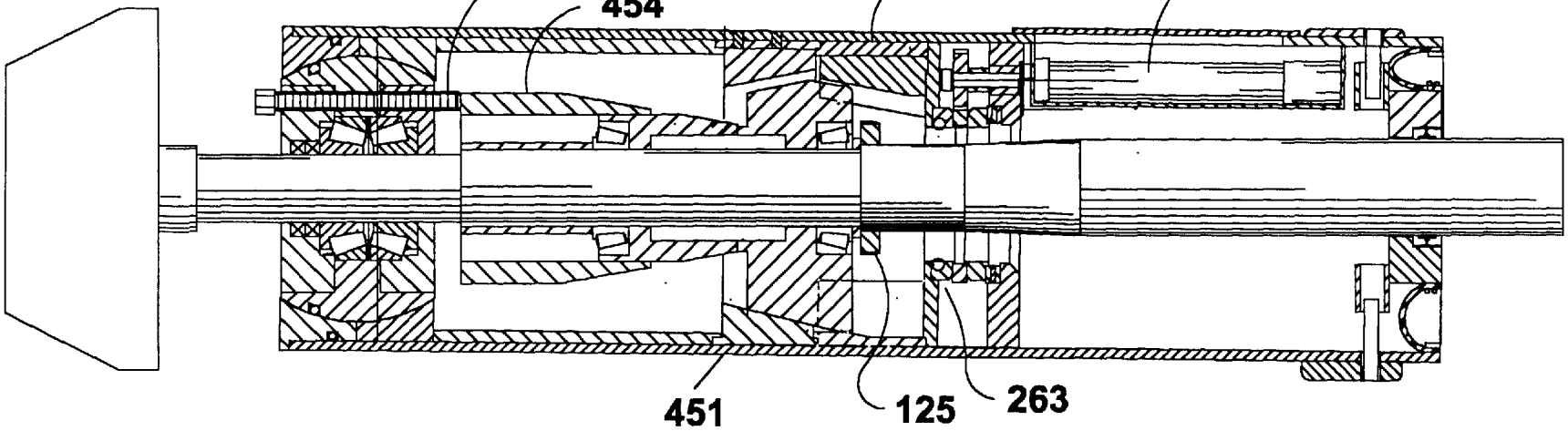
FIG. 45 is a cross-section of the apparatus of FIG. 40 with the housing tilted relative to the shaft.
Figure 43:
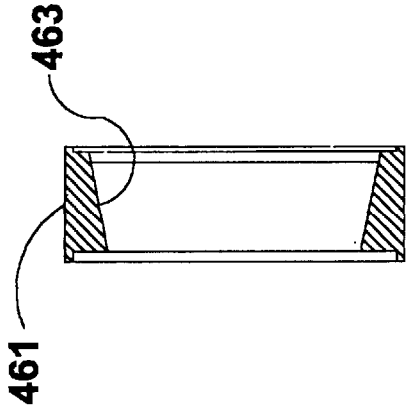
FIG. 43 is a cross-section of FIG. 42 taken along the lines 43—43 thereof.

FIG. 45, shows the housing 451 tilted relative to the shaft 101 and FIG. 40 shows the housing 451 concentric about the shaft 101.

Although not shown, the sondes 361 and 371 and the generator and battery arrangement of FIG. 39 may be located in the housing 451. The housing 451 has a window 451P formed of a material which will allow transmission of wireless signals.

Figure 42:
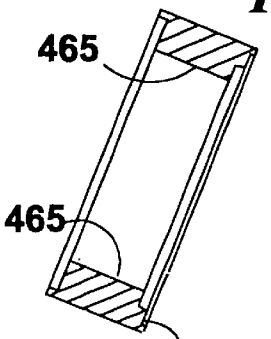
FIG. 42 is a cross-section of FIG. 41 taken along the lines 42—42 thereof.
Figure 44:
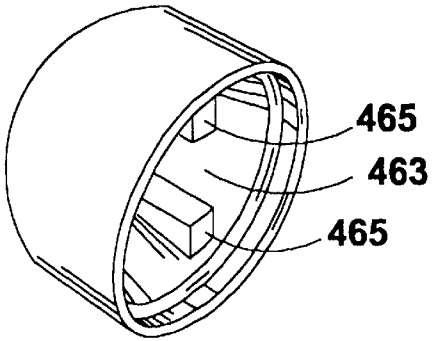
FIG. 44 is an isometric view of the cam of FIG. 41.

A radius adjusting screw 453 and a stop disk 454 connected to the cam follower 131 are provided to vary the radius of turning of the apparatus. When the screw is screwed inward, it limits and reduces the forward travel of the shaft and hence of the cam follower in relation to the guide housing and hence results in a larger turning radius for all turning positions. When the screw 453 is screwed outward (to the left as seen in FIG. 42), it allows the shaft and hence the cam follower to travel further to a forward position and hence results in a smaller turning radius of the apparatus.

The housing 451 of the embodiment of FIGS. 40–45 will be filled with oil but since its volume does not change significantly during shifting, the bladder or piston arrangement of FIGS. 13, 35–38 may not be employed. The member 495 also act as a pressure and volume equalizer which eliminates the need of a piston and bladder. In the embodiment of FIGS. 40–45, turning can be accomplished by tilting the housing relative to the shaft to allow the rear edge of the housing to engage the borehole wall to allow the front edge of the opposite side and hence the drill bit to move in an opposite direction to carry out turning of the unit as it drills.

In the embodiment of FIGS. 40–45 the side cutters 171 and 173 of the embodiment of FIGS. 1–39 will not be employed.

The two sondes 361 and 371 are commercially available and each sends signals to a portable receiver or detector 421 at the surface which in turn sends the information to a receiver 423 at the surface coupled to a cathode ray tube display. The signals sent separately provide information of the depth of the sonde, the pitch or tilt of the axis, and the angle of roll about its axis. The sonde 371 is attached to the guide housing 113 and hence provides information of the location of the straight cams and the sonde 361 is attached to the cam follower housing and hence rotates with the cam follower housing when it rotates relative to the guide housing 113. In the prior art, sondes similar to that of units 361 and 371 have been used to locate directional drilling devices. The known sondes are always fixed to the housing of the drilling device and are not attached to a rotating member in the housing.

The two sondes 361 and 371 transmit at different frequencies. For example, sonde 361 may transmit signals at 8 MHz and sonde 371 may transmit signals at 33 MHz to be displayed. Each unit 421 and 423 has three separate displays to allow the depth, roll and pitch to be displayed. The unit 423 will be located at a fixed position near the drilling system 103 and the unit 421 is a portable unit that can be carried by an operator. Assume the embodiment of FIGS. 1–34 is to be used. The position of the cam 256 is defined as the 12 o'clock position. The operator moves the unit 421 around until the strongest signal is picked up. This indicates to the operator that the sonde 361 is directly below the unit. The operator then sets the unit on the ground and at that spot he can operate the depth switch to obtain depth information from sondes 361 and 371. The pitch and roll are readable at all times when the receiver is in range of the sonde. The information of roll from the two units 361 and 371 is important. The operator wants to know the position of the straight cam, for example cam 241 relative to the 12 o'clock position. When drilling first begins, the operator knows which cam the cam follower is engaging. This tells him the rotational position of the straight cam. As long as the apparatus is in the drilling mode, the position of the straight cams will have the same relationship with the sonde 361 as when drilling began since during drilling, the sonde 361 is connected to the cam follower which engages a cam. When a change in direction of drilling is desired, the operator switches to the shifting mode. In this mode the sonde 361 is no longer connected to the cams but is still linked to the cam follower. The cam follower is free to be rotated in the housing which means the sonde 361 is free to be rotated in relation to the housing. Knowing the position of the straight cams, the operator can locate the cam follower to engage the desired cam.

If the housing rolls during drilling, the cams will also roll. By knowing the direction and amount of housing roll, the operator can use this information to determine the direction and amount of roll of the straight cams since the cams will roll with the housing. This information allows the operator to determine position of the straight cams which allows him to locate the cam follower to engage the desired cam. The housing sonde 371 is desirable but not necessary in all cases.

Figure 46:
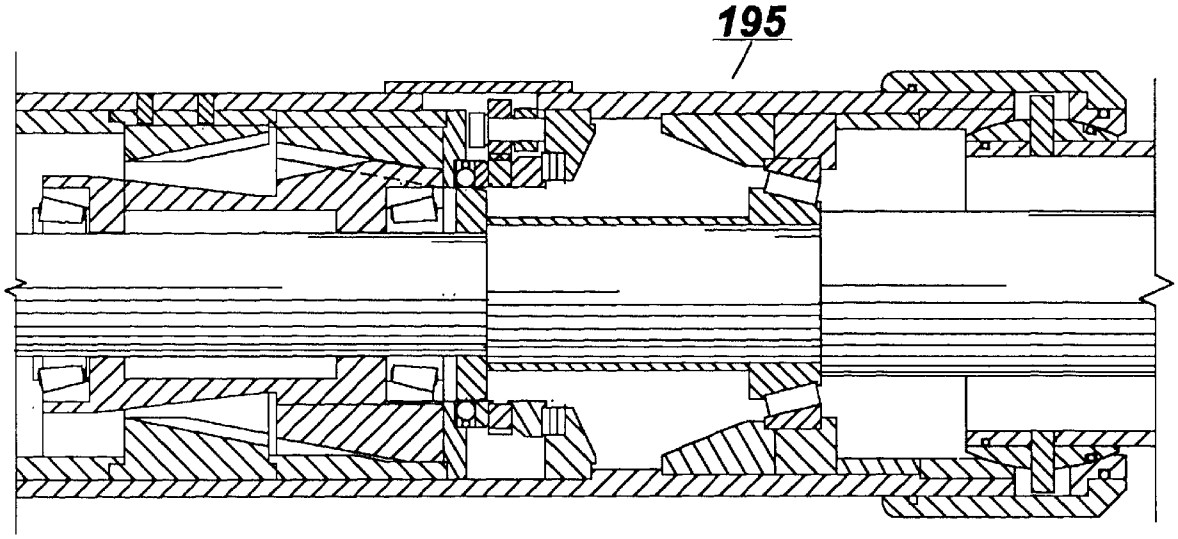
FIGS. 46 and 47 illustrate a rear shifting guide with the shaft in the drilling mode in FIG. 47 and in a shifting mode in FIG. 46.
Figure 47:
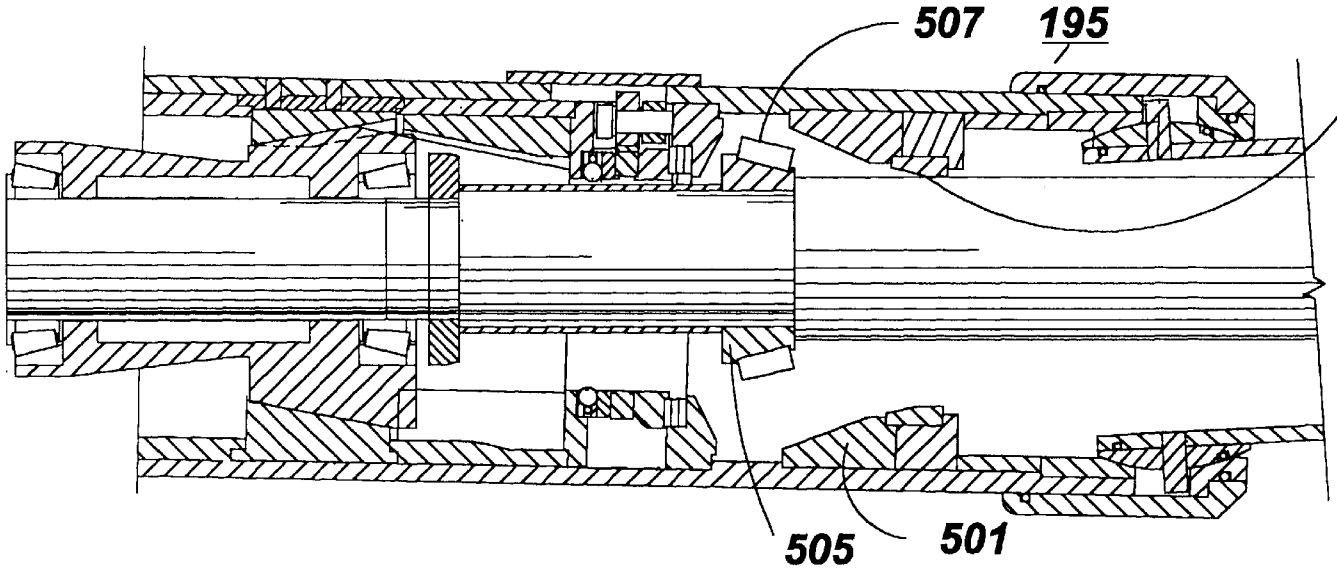

Referring now to FIGS. 46 and 47, there is disclosed a modification of the guide housing 113 of the embodiment of FIGS. 1–34 and of the embodiment of FIGS. 40–45. The housing shown is the guide housing of FIGS. 1–34. Attached to the inside of the tube 195 is an annular cup 501 having bearing surfaces 503 for receiving an annular cone 505 having bearings 507. In the drilling mode, the bearings 505 disengage the cone 501. In the shifting mode, the bearings 507 of the cone 505 engage the bearing surfaces 503 of the cone 501. This provides a precision concentric relationship between the housing 195 and the shaft 101 when the shaft is in the shifting mode. Without this feature, the sprocket seats against the outer clutch ring 263 when the shaft is in the shifting mode which places a load on the sprocket.

As indicated above, the rotating guide cutters 171 and 173 are perpendicular to the shaft 101. In an alternative embodiment, these rotatable cutters may be located parallel to the shaft 101. In this embodiment annular gears are coupled to the shafts of the cutters 171 and 173 which are supported by bearings coupled to the housing for rotation. An annular gear is coupled to the shaft 101 which mesh with the annular gears coupled to the shafts of the cutters 171 and 173 to rotate the cutters 171 and 173. The cutter arrangement in the alternative embodiment tend to create roll to the shaft 101 and the cutters 171 and 173 with shafts perpendicular to the shaft 101 are preferred.

Referring to FIG. 15, there is disclosed several metal leaf springs 553 connected to the guide housing 113 with a drag strip 551 connected to each spring 553. The strips 551 may have tungsten carbide members welded thereto. The purpose of the members 553, 551 is to provide a drag on the housing 113 while the shaft 101 and housing 111 are moved forward from the shifting position to the drilling position. The drag means facilitates shifting but will not affect forward drilling since the drill system 103 has sufficient power to overcome any drag produced by the members 553, 551. The members 553, 551 may be attached to the housing 117 rather than to the housing 113.

I claim:

1. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, cam means coupled to said guide housing at different angular positions around said shaft, a cam follower coupled to a cam follower housing which surrounds said shaft, said cam follower being disengaged from said cam means when said shaft is in said shifting position, said cam follower housing and said cam follower being rotatable together relative to said guide housing when said shaft is in said shifting position, said cam follower being movable longitudinally with said shaft relative to said cam follower housing and relative to said cam means, a clutch for coupling said cam follower housing to said shaft when said shaft is in said shifting position such that said cam follower housing and hence said cam follower may be rotated with said shaft relative to said cam means to allow said cam follower to engage said cam means at a selected angular position around said shaft when said shaft is moved to said forward drilling position, when said shaft moves toward said forward drilling position said clutch allows said cam follower housing to be uncoupled from said shaft such that in said forward drilling position of said shaft, said cam follower engages said cam means and causes said axis of said guide housing to shift relative to said axis of said shaft to cause the direction of drilling by said shaft and said cutting means to change.

2. The apparatus of claim 1, comprising:

a rotational indicator coupled to said cam follower for rotation therewith and relative to said cam means for indicating the rotational position of said cam follower relative to said cam means, and means for transmitting to the surface by a signal an indication of the rotational position of said cam follower relative to said cam means.

3. The apparatus of claim 2, comprising:

a roll indicator coupled to said cam means, for indicating the roll of said cam means, and means for transmitting to the surface, a signal which provides information of the roll of said cam means.

4. The apparatus of claim 2, wherein:

said means for transmitting comprises an electrically actuated transmitting means, electrical generating means coupled to said shaft for rotation for generating an electrical output for application to said electrically actuated transmitting means.

5. The apparatus of claim 2, wherein:

when said shaft is in said forward drilling position, said rotational indicator is coupled to said cam follower and said guide housing and when said apparatus is in said shifting position, said rotational indicator is coupled to said cam follower and uncoupled from said guide housing.

6. The apparatus of claim 1 wherein:

said cam means comprises a conical shaped surface to be engaged by said cam follower.

7. The apparatus of claim 1, wherein:

said cam means comprises a conical shaped surface and at least one other surface to be selectively engaged by said cam follower.

8. The apparatus of claim 1, wherein:

said cam means comprises a plurality of cams coupled to said guide housing at different angular positions around said shaft to be selectively engaged by said cam follower.

9. The apparatus of claim 8, wherein:

selected ones of said plurality of said cams have different slopes.

10. The apparatus of claim 1, wherein:

said cam follower comprises two cam members angularly spaced apart with one of said cam members being adapted to engage said cam means, said cam follower housing comprises two slots angularly spaced apart for slidably receiving said two cam members respectively such that said two cam members are located in said two slots when said shaft is in said drilling position and in said shifting position.

11. The apparatus of claim 1, wherein said clutch comprises:

a sprocket connected to said shaft and means with at least on spring biased ball connected to said cam follower housing for engaging and disengaging said sprocket.

12. The apparatus of claim 1, comprising:

a front shaft support housing coupled to said guide housing for longitudinal movement with said shaft relative to said guide housing, said shaft extending through said front shaft support housing.

13. The apparatus of claim 12, comprising:

roll stabilization means coupled to said apparatus for preventing said housings from rotating about said axis.

14. The apparatus of claim 13, comprising:

side cutting means coupled to said front shaft support housing for cutting at least one side aperture in the earth extending transverse to the hole while the hole is being formed for receiving said roll stabilization means as said apparatus is moved in the hole.

15. The apparatus of claim 14, wherein:

said side cutting means comprises a rotation cutting means coupled to said shaft for rotation by said shaft while said shaft is rotating.

16. The apparatus of claim 14, wherein said roll stabilization means comprises:

at least one guide which extends outward into the side aperture as the apparatus is moved in the hole being drilled.

17. The apparatus of claim 14, comprising:

a rotational indicator coupled to said cam follower for rotation therewith and relative to said guide housing for indicating the rotational position of said cam follower relative to said cam means, means for transmitting to the surface by a signal an indication of the rotational position of said cam follower relative to said cam means, a roll indicator coupled to said cam means for indicating the roll of said cam means, and means for transmitting to the surface, a signal which provides information of the roll of said cam means.

18. The apparatus of claim 17, comprising:

at least one guide coupled to said apparatus rearward of said front shaft support housing which extends outward into the side aperture as said apparatus is moved in the borehole being drilled.

19. The apparatus of claim 12, wherein:

said front shaft support housing has a rear end and said guide housing has a forward end, a flexible sleeve coupled to said rear end of said front shaft support housing and to said forward end of said guide housing and being capable of being folded when said front shaft support is in said rearward shifting position and unfolded when said front shaft support is in said forward drilling position.

20. The apparatus of claim 19, comprising:

a rear shaft support housing coupled to said guide housing, said front shaft support housing, said guide housing and said rear shaft support housing being in fluid communication with each other and defining an interior volume that varies when said front shaft support housing is moved by said shaft relative to said guide housing, a lubricating liquid located in said front shaft support housing, said guide housing and said rear shaft support housing, and a variable volume means located in one of said housings for receiving water from the borehole when said interior volume increases and discharging said received water into the borehole when said interior volume decreases.

21. The apparatus of claim 1, wherein:

said clutch couples said cam follower housing to said shaft at a given position when said shaft is in said shifting position, a rear bearing comprising a first portion coupled to said shaft rearward of said given position, and a second portion coupled to the inside of said housing for engaging said first portion when said shaft is in said shifting position.

22. The apparatus of claim 1, comprising:

spring means coupled to said apparatus and normally biased outward for engaging the wall of the hole being drilled.

23. The apparatus of claim 1, comprising:

a first indicator coupled to said cam follower for rotation therewith, a second indicator coupled to said cam means for rotation therewith, said first and second indicators being capable of transmitting to the surface first and second signals respectively of different frequencies representative of information about the positions of said cam follower and of said cam means respectively.

24. The apparatus of claim 1, wherein:

said cam follower and said cam follower housing maintains said axis of said guide housing generally aligned with said axis of said shaft when said guide housing is in said shifting position, and adjustable stop means supported to restrict forward longitudinal movement of said shaft and hence of said cam follower relative to said cam means to control the amount of shift of said axis of said guide housing relative to said axis of said shaft.

25. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, means located in said guide housing and controllable by movement of said shaft in said shifting position for locating said axis of said guide housing in at least first and second positions relative to said axis of said shaft, in said first position, said axis of said housing generally coincides with said axis of said shaft to allow said apparatus to drill straight, in said second position, said axis of said guide housing is shifted relative to said axis of said shaft to cause the direction of said apparatus to turn while drilling operations are carried out, in said first and second positions of said guide housing relative to said axis of said shaft, said shaft is rotatable relative to said guide housing.

26. The apparatus of claim 25, comprising:

a front shaft support housing coupled to said guide housing for longitudinal movement with said shaft relative to said guide housing, said shaft extending through said front shaft support housing, side cutting means coupled to said front shaft support housing for cutting at least one side aperture in the earth extending transverse to the borehole while the borehole is being formed, at least one guide coupled to said apparatus rearward of said front shaft support housing which extends outward into the side aperture as the apparatus is moved forward in the borehole being drilled.

27. The apparatus of claim 25, wherein:

in said second position of said guide housing relative to the axis of said shaft, said axis of said guide housing forms an acute angle relative to said axis of said shaft within said guide housing.

28. The apparatus of claim 27, comprising:

means for preventing said guide housing from rotating in the hole while the hole is being drilled.

29. The apparatus of claim 25, comprising:

means for preventing said guide housing from rotating in the hole while the hole is being drilled.

30. The apparatus of claim 25, comprising:

side cutting means coupled to said apparatus for cutting in the earth, at least one side aperture transverse to the hole while the hole is being drilled, at least one guide coupled to said apparatus rearward of said side cutting means and which extends into the side aperture as said apparatus is being moved forward in the hole being drilled.

31. The apparatus of claim 30, wherein:

said side cutting means comprises a rotatable side cutting means coupled to said shaft for rotation by said shaft when said shaft is rotating.

32. The apparatus of claim 31, wherein:

said side cutting means comprises two cutting means coupled to said shaft on opposite sides thereof by means for rotating said two cutting means in the same direction along an axis transverse to said axis of said shaft.

33. An apparatus for drilling a hole in the earth, comprising:

a guide housing having a given axis, a shaft extending through said guide housing, said shaft having a central axis and a forward end, cutting means coupled to said forward end of said shaft for drilling purposes, upon rotation of said shaft, said shaft being movable longitudinally relative to said guide housing such that said shaft may be movable to a forward drilling position relative to said guide housing and to a rearward shifting position relative to said guide housing, means located in said guide housing and controllable by movement of said shaft in said shifting position for locating said axis of said housing in at least first and second positions relative to said axis of said shaft, in said first position, said axis of said guide housing generally coincides with said axis of said shaft to allow said apparatus to drill straight, in said second positions, said axis of said housing is shifted relative to said axis of said shaft to cause the direction of said apparatus to turn while drilling operations are carried out, a front shaft support housing coupled to said guide housing for longitudinal movement with said shaft relative to said guide housing, said shaft extending through said front shaft support housing, side cutting means coupled to said front shaft support housing for cutting at least one side aperture in the earth extending transverse to the borehole while the borehole is being formed, at least one guide coupled to said apparatus rearward of said front shaft support housing which extends outward into the side aperture as the apparatus is moved forward in the hole being drilled.

* * * * *